US009827659B2

(12) United States Patent
Matsuno

(10) Patent No.: US 9,827,659 B2
(45) Date of Patent: Nov. 28, 2017

(54) DRIVER TOOL

(71) Applicant: MAKITA CORPORATION, Anjo-shi (JP)

(72) Inventor: Tadasuke Matsuno, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 469 days.

(21) Appl. No.: 14/391,283

(22) PCT Filed: Apr. 4, 2013

(86) PCT No.: PCT/JP2013/060376
§ 371 (c)(1),
(2) Date: Oct. 8, 2014

(87) PCT Pub. No.: WO2013/154033
PCT Pub. Date: Oct. 17, 2013

(65) Prior Publication Data

US 2015/0129630 A1 May 14, 2015

(30) Foreign Application Priority Data

Apr. 9, 2012 (JP) ..... 2012-088843

(51) Int. Cl.
*B25C 1/04* (2006.01)
*B25C 1/06* (2006.01)
(Continued)

(52) U.S. Cl.
CPC ..... *B25C 1/047* (2013.01); *B25C 1/04* (2013.01); *B25C 1/06* (2013.01); *B25C 1/008* (2013.01); *B25D 9/08* (2013.01); *B25D 11/125* (2013.01)

(58) Field of Classification Search
CPC B25C 1/04; B25C 1/043; B25C 1/046; B25C 1/06; B25C 5/10; B25C 5/13;
(Continued)

(56) References Cited

U.S. PATENT DOCUMENTS 1,071,387 A * 8/1913 Behr ..... B25D 11/125 173/201
1,829,609 A * 10/1931 Robinson ..... B25D 9/08 173/135
(Continued)

FOREIGN PATENT DOCUMENTS

JP S63229274 A 9/1988
JP H01115579 A 5/1989
(Continued)

OTHER PUBLICATIONS

Office Action from the Japanese Patent Office dated Jun. 2, 2015 in related Japanese application No. 2012-088842, and translation of substantive portions thereof.
(Continued)

*Primary Examiner* — Scott A. Smith
(74) *Attorney, Agent, or Firm* — J-Tek Law PLLC; Jeffrey D. Tekanic; Scott T. Wakeman

(57) ABSTRACT

A driving tool includes a first piston slidably disposed within a cylinder chamber and having an elongated driving part configured to drive a struck material. A second piston is configured to generate compressed air within the combustion chamber. A compressed air supply passage enables communication between the compression chamber and the cylinder chamber. A valve member opens and closes the compressed air supply passage. A relay member mechanically connects an electric motor with the valve member. The valve member opens and closes the compressed air supply passage via the relay member.

16 Claims, 23 Drawing Sheets

(51) Int. Cl.
*B25C 1/00* (2006.01)
*B25D 9/08* (2006.01)
*B25D 11/12* (2006.01)

(58) Field of Classification Search
CPC B25C 5/15; B25C 1/041; B25C 1/047; F16H 53/04; F16H 15/02; F16H 15/149; F16H 11/06; B25D 9/08; B25D 11/125
USPC ..... 227/8, 130, 131, 2, 129, 136; 91/304, 91/309, 461, 417 A; 60/370, 542, 547.1, 60/591; 173/200, 201, 122
See application file for complete search history.

(56) References Cited

U.S. PATENT DOCUMENTS

| | | | | |
|---|---|---|---|---|
| 3,602,103 | A * | 8/1971 | Powers | F15B 11/06 137/625.6 |
| 3,821,992 | A * | 7/1974 | Matsuo | B25D 9/08 173/200 |
| 3,878,902 | A * | 4/1975 | Matsuo | B25D 11/125 173/122 |
| 4,344,555 | A * | 8/1982 | Wolfberg | B25C 1/043 227/130 |
| 5,996,874 | A | 12/1999 | Fukushima et al. | |
| 6,755,336 | B2 * | 6/2004 | Harper | B25C 1/06 227/129 |
| 7,419,079 | B2 * | 9/2008 | Chen | B25C 5/1693 227/130 |
| 7,793,811 | B1 * | 9/2010 | Pedicini | B25C 1/047 227/130 |
| 8,079,504 | B1 | 12/2011 | Pedicini et al. | |
| 2007/0045377 | A1 | 3/2007 | Towfighi | |
| 2007/0138230 | A1 | 6/2007 | Gschwend et al. | |
| 2008/0190988 | A1 | 8/2008 | Pedicini et al. | |
| 2009/0090762 | A1 | 4/2009 | Leimbach et al. | |
| 2009/0184148 | A1 | 7/2009 | Dittrich et al. | |
| 2009/0321492 | A1 | 12/2009 | Shima et al. | |
| 2010/0213235 | A1 | 8/2010 | Pedicini et al. | |
| 2010/0236802 | A1 | 9/2010 | Berger et al. | |
| 2010/0237126 | A1 | 9/2010 | Matsunaga et al. | |
| 2011/0108600 | A1 | 5/2011 | Pedicini et al. | |
| 2011/0155403 | A1 | 6/2011 | Rohrer | |
| 2011/0240709 | A1 | 10/2011 | Oouchi | |
| 2012/0187178 | A1 | 7/2012 | Campbell | |
| 2012/0286014 | A1 | 11/2012 | Pedicini et al. | |
| 2014/0054350 | A1 | 2/2014 | Pedicini | |
| 2014/0374461 | A1 | 12/2014 | Pedicini et al. | |
| 2015/0129630 | A1 | 5/2015 | Matsuno | |
| 2015/0158160 | A1 | 6/2015 | Kato | |
| 2015/0174748 | A1 | 6/2015 | Furuta et al. | |
| 2015/0217436 | A1 | 8/2015 | Yanagihara et al. | |
| 2015/0298308 | A1 | 10/2015 | Kato | |
| 2015/0314432 | A1 | 11/2015 | Yang et al. | |

FOREIGN PATENT DOCUMENTS

| | | | |
|---|---|---|---|
| JP | H0396751 | A | 4/1991 |
| JP | H666967 | U | 9/1994 |
| JP | 200417206 | A | 1/2004 |
| JP | 2004017206 | A | 1/2004 |
| JP | 200990384 | A | 4/2009 |
| JP | 2009172762 | A | 8/2009 |
| JP | 20105776 | A | 1/2010 |
| JP | 2010173044 | A | 8/2010 |
| JP | 2011025362 | A | 2/2011 |
| JP | 2011025363 | A | 2/2011 |
| JP | 2011056613 | A | 3/2011 |
| JP | 2012148346 | A | 8/2012 |
| JP | 2012518553 | A | 8/2012 |
| JP | 2013233608 | A | 11/2013 |
| WO | 2011010511 | A1 | 1/2011 |
| WO | 2013168718 | A1 | 11/2013 |
| WO | 2014069648 | A1 | 5/2014 |

OTHER PUBLICATIONS

Office Action from the Japanese Patent Office dated Jun. 2, 2015 in related Japanese application No. 2012-088843, and translation of substantive portions thereof.
Office Action from the German Patent Office dated Feb. 2, 2016 in related German application No. 11 2013 001 962.0, and translation of substantive portions thereof.
Office Action from the German Patent Office dated Jan. 26, 2016 in related German application No. 11 2013 001 960.4, and translation of substantive portions thereof.
Office Action dated Feb. 27, 2017 in related U.S. Appl. No. 14/391,263 and examined claims 1-20.
Unpublished U.S. Appl. No. 14/399,647.
Unpublished U.S. Appl. No. 14/440,143.
Unpublished U.S. Appl. No. 14/565,993.
Unpublished U.S. Appl. No. 14/685,783.
Unpublished copending U.S. Appl. No. 14/391,263.
Written Opinion from PCT/JP2013/060375 (now U.S. Appl. No. 14/391,263) discussing JP 563-229274 in connection with claims of PCT/JP2013/060375.
Claims of Unpublished copending U.S. Appl. No. 14/391,263.
International Search Report from PCT/JP2013/060376.
Written Opinion from PCT/JP2013/060376.
Final Office Action from the United States Patent Office dated Jun. 26, 2017 in related U.S. Appl. No. 14/391,263, including examined claims 1-20.

* cited by examiner

DRIVER TOOL

CROSS-REFERENCE

This application is the U.S. National Stage of International Application No. PCT/JP2013/060376 filed on Apr. 4, 2013, which claims priority to Japanese patent application no. 2012-088843 filed on Apr. 9, 2012.

TECHNICAL FIELD

The present invention relates to a driving tool that performs a driving operation of a struck material.

BACKGROUND ART

Japanese Laid-open Patent Publication No. 2011-25363 discloses an electric/pneumatic driving tool having a battery-powered electric motor and a compression device which is driven by the electric motor. In this driving tool, when air in a compression chamber is compressed to the maximum, a valve member is opened and the compressed air in the compression chamber is supplied into a driving cylinder. A driving mechanism is then actuated by this compressed air to drive in a struck material to be driven.

SUMMARY OF THE INVENTION

In the driving tool described in Japanese Laid-open Patent Publication No. 2011-25363, when a prescribed time elapses after the compression device is activated, it is necessary to control the valve member of a passage that provides communication between the compression chamber and the cylinder chamber. For this purpose, a solenoid valve is used as the valve member.

However, because the solenoid valve has a poor responsiveness, it is difficult to open the passage at the time when air in the compression chamber is compressed to the maximum.

The present invention has been made in view of the problem above and it is an object of the present invention to provide a driving tool that has been improved to accurately control a valve member.

The above-described problem can be solved by claim 1. A preferred aspect of a driving tool according to the present invention includes a motor, a cylinder having a cylinder chamber, a first piston that is disposed so as to be slidable within the cylinder chamber and has a sliding part and an elongate driving part which is connected to the sliding part and drives a struck material, a compression device that has a compression chamber and generates compressed air by a change of the volume of the compression chamber, a second piston that is disposed so as to be slidable within the compression chamber and is configured to generate compressed air, a compressed air supply passage that provides communicate between the compression chamber and the cylinder chamber, a valve member that opens and closes the compressed air supply passage, and a relay member that mechanically connects the motor and the valve member and is configured to be capable of controlling the valve member when the motor is driven. Further, it is configured to perform an opening and a closing of the compressed air supply passage by the valve member via the relay member. Further, the first piston is configured to drive the struck material by the compressed air supplied from the compression chamber into the cylinder chamber. Further, the "driving tool" in the present invention corresponds in a representative manner to nailers or tackers. The "struck material" suitably includes straight rod-like items with a sharp point or to staples having a U-shape.

According to the present invention, because the valve member is mechanically controlled by the relay member, the valve member is accurately controlled.

According to a further aspect of a driving tool of the present invention, it includes a crank mechanism that is driven by the motor to reciprocate the second piston within the compression chamber, and a cam member that is connected to the crank mechanism and is rotatably driven. The relay member mechanically connects the cam member and the valve member and is configured to convert rotation of the cam member into linear motion and to transmit the motion to the valve member. Further, it is configured to perform the opening and closing of the compressed air supply passage by the valve member via the relay member according to the amount of the cam lift of the cam member.

According to this aspect, because the control of the valve member is performed by the cam member that is mechanically connected to the crank mechanism, which drives the second piston of the compression device and is rotatably driven, the valve member is controllable according to the crank angle of the crank mechanism. As a result, the valve member is accurately controlled.

According to a further aspect of the driving tool of the present invention, the amount of the cam lift of the cam member is set such that the valve member opens the compressed air supply passage when the air in the compression chamber is compressed to the maximum.

According to this aspect, the valve member opens the compressed air supply passage at the time when the pressure in the compression chamber reaches its maximum. Therefore, the compressed air generated in the compression device is efficiently used for the nail driving operation.

According to a further aspect of the driving tool of the present invention, the amount of the cam lift of the cam member is set such that the compressed air supply passage is held open by the valve member until the first piston completes driving the struck material and returns to an initial position.

According to this aspect, because the compressed air supply passage is held open by the valve member until the first piston returns to the initial position, the first piston reliably returns to the initial position by the reduction of pressure in the compression chamber.

According to a further aspect of the driving tool of the present invention, the crank mechanism has a crank shaft, and the cam member is configured to be rotatably driven around the crank shaft. The relay member is configured to move in a direction crossing an axial direction of the crank shaft so as to convert the rotation of the cam member into linear motion and to transmit the linear motion to the valve member. The valve member is configured to open and close the compressed air supply passage by moving in the crossing direction.

According to this aspect, power transmission from the cam member to the valve member via the relay member can be rationally realized.

According to a further aspect of the driving tool of the present invention, the cylinder and the compression device are each formed as a cylindrical cylinder and disposed in parallel to each other such that the axes of their cylindrical cylinders extend in a prescribed direction. The relay member is arranged to extend in the prescribed direction between outer walls of the cylinder and the compression device.

According to this aspect, because the relay member is arranged between the outer walls of the cylinder and the compression device, each component is rationally arranged.

According to a further aspect of the driving tool of the present invention, the cam member is formed by combining a plurality of cam plates, and the amount of cam lift relative to the relay member is set by the combination of the cam plates. In addition, the position(s) of the cam plate(s) is (are) configured to be adjustable, and the time when the opening time of the compressed air supply passage by the valve member is configured to be adjustable by adjusting the position(s) of the cam plate(s).

According to this aspect, the amount of cam lift can be adjusted by the combination of the cam plates. For example, it may be configured such that the compressed air supply passage is opened by one cam plate and the open state of the compressed air supply passage is held by the other cam plate. Thereby, adjustment of the cam shape of each becomes easy. In addition, the opening time of the compressed air supply passage is adjusted by adjusting the position(s) of each of the cam plates.

According to a further aspect of a driving tool of the present invention, cam followers are provided corresponding to each of the cam plates. Further, rotation of the cam plates is individually transmitted to the relay member via the respective cam followers.

According to this aspect, the shape of the contact surface of each of the cam followers in contact with the respective cam plates is individually designed according to the respective cam shapes. Thus, the responsiveness of each of the cam followers with respect to the cam plates can be increased.

According to a further aspect of the driving tool of the present invention, the crank mechanism has a crank shaft and the cam member is configured to be rotatably driven around the crank shaft. The relay member is configured to be reciprocally pivoted, with a prescribed rotating shaft serving as a rotation fulcrum, in a direction containing a component in a direction of a rotation axis of the cam member, and to convert the rotation of the cam member into linear motion and to transmit the motion to the valve member. The valve member is configured to open and close the compressed air supply passage by moving in an axial direction of the first piston.

According to this aspect, power transmission from the cam member to the valve member via the relay member can be rationally realized.

According to a further aspect of the driving tool of the present invention, the relay member is arranged to extend alongside an axial direction of the second piston outside the compression device. In addition, the rotation fulcrum of the relay member is provided in a middle region of the relay member in the axial direction of the second piston.

According to this aspect, because the relay member is arranged outside and alongside the compression chamber and the rotation fulcrum is provided in the middle region of the relay member, each component is rationally arranged.

According to a further aspect of the driving tool of the present invention, the valve member is disposed coaxially with the first piston, and when the first piston drives the struck material by the compressed air supplied into the cylinder chamber, the valve member is configured to move in an opposite direction from a direction that the first piston moves by the compressed air.

According to this aspect, the valve member acts as a counter weight when the first piston drives the struck material. Therefore, vibrations generated during the driving operation of the first piston can be reduced. In this case, the mass of the valve member or the total mass of the valve member and the relay member, which moves together with the valve member, is preferably set to be substantially equal to the mass of the first piston.

According to a further aspect of the driving tool of the present invention, the pressure receiving area of the valve member, which receives pressure of the compressed air supplied into the compression chamber, is set to be equal to the pressure receiving area of the sliding part, which receives pressure of the compressed air.

According to this aspect, by setting the pressure receiving area of the valve member to be equal to the pressure receiving area of the first piston, the valve member efficiently acts as a counter weight.

According to the present invention, an improved driving tool is provided to accurately control a valve member.

Other objects, features and advantages of this invention will be readily understood after reading the following detailed description together with the accompanying drawings and the claims.

DETAILED DESCRIPTION

Each of the additional features and method steps disclosed above and below may be utilized separately or in conjunction with other features and method steps to provide improved driving tools and devices utilized therein. Representative examples of this invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

Figure 1:
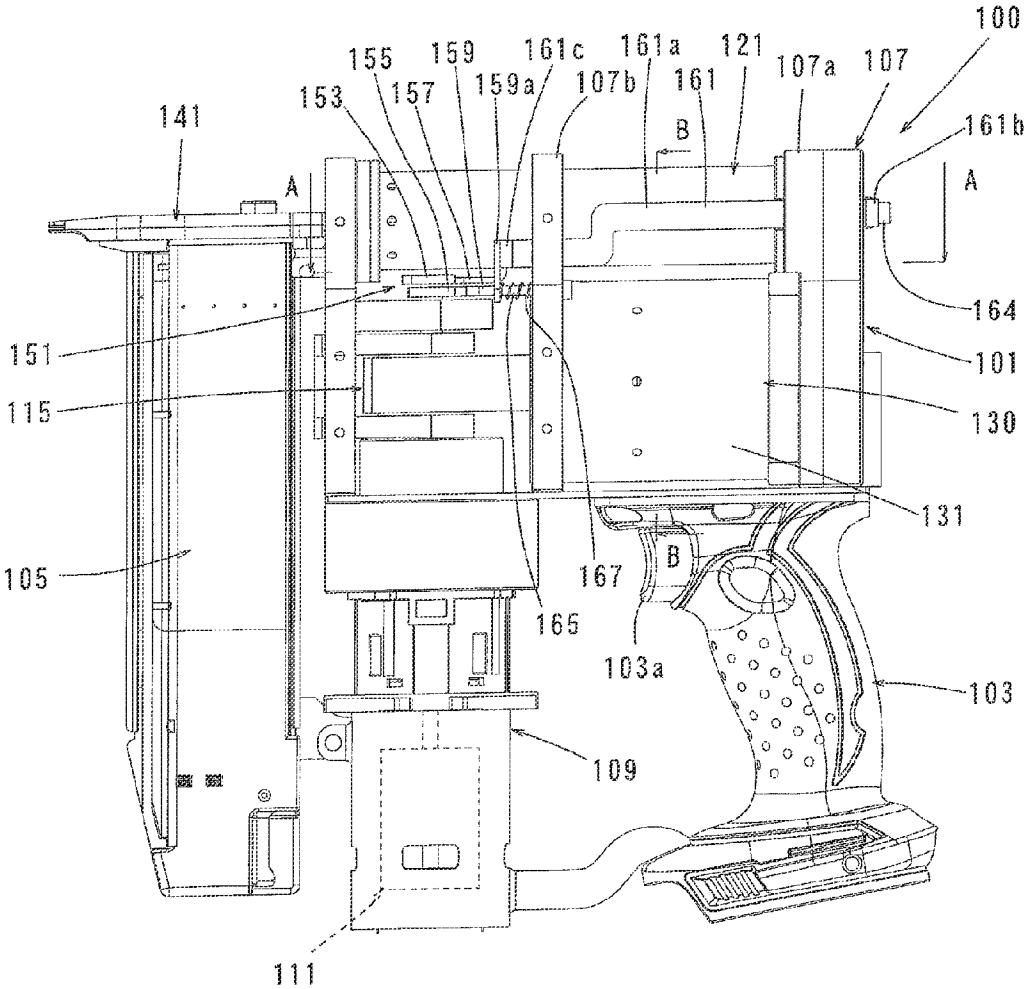
FIG. 1 is an external view showing the overall structure of a nailer according to a first embodiment of the invention.

A first embodiment of the present invention will now be described with reference to FIGS. 1 to 20. This embodiment will be explained using an electric-pneumatic nailer as one example of a driving tool according to the present invention. As shown in FIG. 1, a nailer 100 mainly includes a body 101 serving as a tool body, an elongate handle 103 designed to be held by a user, and a magazine 105 that stores nails (not shown) serving as a struck material to be driven into a workpiece.

The handle 103 is integrally formed with the body 101 such that it projects in a direction (downward as viewed in FIG. 1) crossing a longitudinal direction of the body 101 (the horizontal direction as viewed in FIG. 1) from one (right as viewed in FIG. 1) end region of the body 101 in its longitudinal direction. A battery mounting part, on which a rechargeable battery pack (not shown) is mounted, is provided on a distal end of the handle 103. Further, FIG. 1 shows the nailer 100 pointed sideways with a front end (left end as viewed in FIG. 1) of the body 101 pointed at the workpiece. Therefore, the leftward direction in FIG. 1 is a nail driving direction (discharge direction). Further, this nail driving direction is a nail striking direction in which a driver 125 strikes a nail.

As shown in FIG. 1, the body 101 mainly includes a body housing 107 with which a driving cylinder 121 of a nail driving mechanism 120 and a compression cylinder 131 of a compression device 130 are integrally formed, and a driving part housing 109 that houses an electric motor 111 and a planetary gear type, speed reducing mechanism (not shown). The driving part housing 109 is disposed on a front (left as viewed in FIG. 1) end region of the body housing 107 substantially in parallel to the handle 103 with a prescribed spacing therebetween. Further, one end of the driving part housing 109 in its longitudinal direction is connected to the body housing 107, and the other end is connected to the distal end of the handle 103. Each of the body housing 107 and the driving part housing 109 is formed by joining a pair of substantially symmetrical housings together.

A driver guide 141 that constitutes a nail discharge port is provided on the front end (left end as viewed in FIG. 1) of the driving cylinder 121 of the body housing 107. The magazine 105 is arranged close and substantially parallel to the driving part housing 109 on the front end of the body 101. Further, one end of the magazine 105 is connected to the driver guide 141 and the other end is connected to the driving part housing 109. The magazine 105 has a pusher plate (not shown) for pushing the nails upward as viewed in FIG. 1. The pusher plate feeds the nails one by one into a driving passage 141*a* (see FIG. 4) of the driver guide 141 from a direction crossing the nail driving direction. Further, for the sake of convenience of explanation, the front end side of the nailer 100 (the left as viewed in FIG. 1) is taken as the front or front side and its opposite side (the right as viewed in FIG. 1) is taken as the rear or rear side. The side (upper side as viewed in FIG. 1) on which the driving cylinder 121 is disposed is taken as the top or upper side, and the side (lower side as viewed in FIG. 1) on which the handle 103 is disposed is taken as the bottom or lower side.

Figure 4:
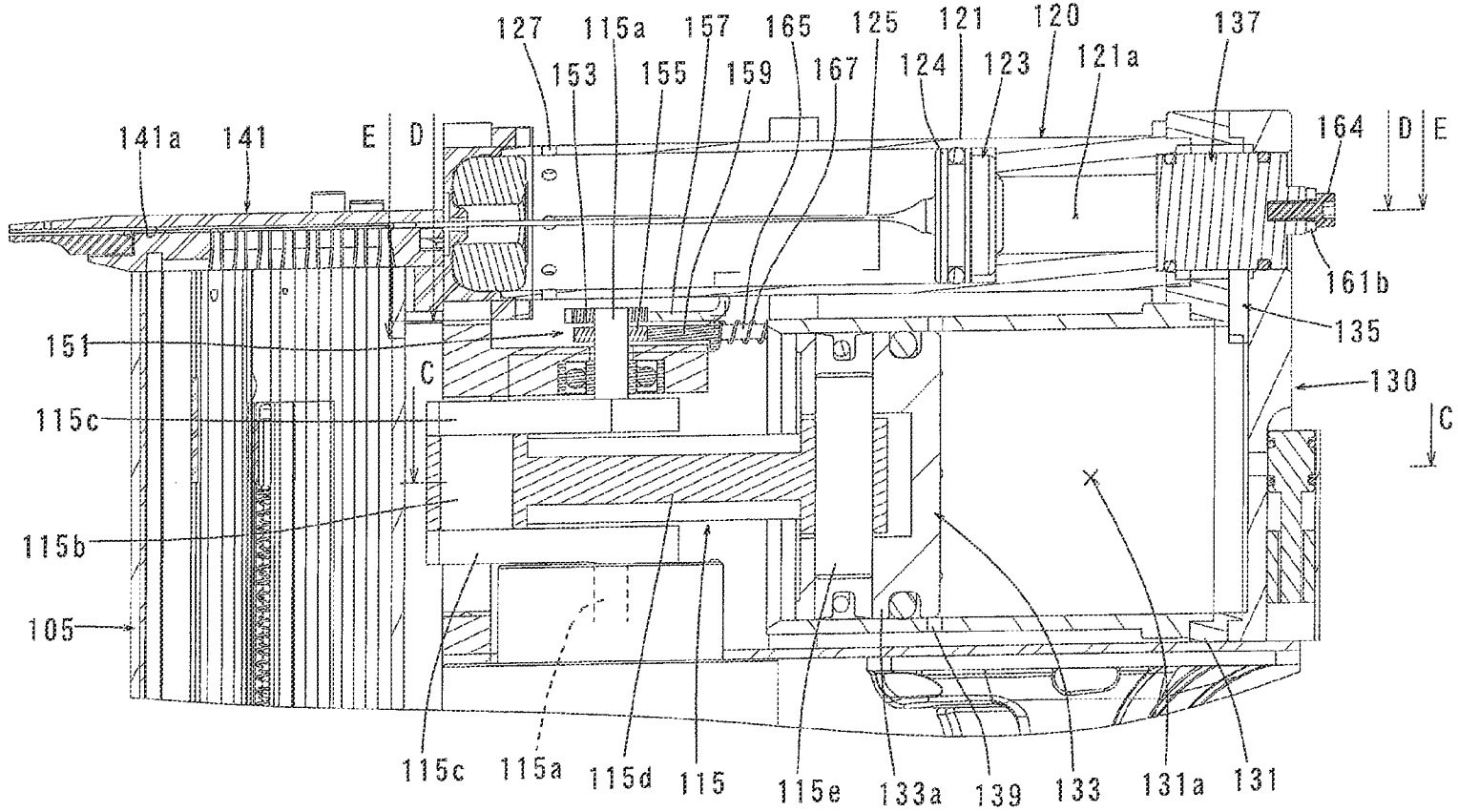
FIG. 4 is a sectional view showing the positional relationships of a compression piston, a driving piston and a valve when a crank angle (θ) is zero degrees (at bottom dead center).
Figure 5:
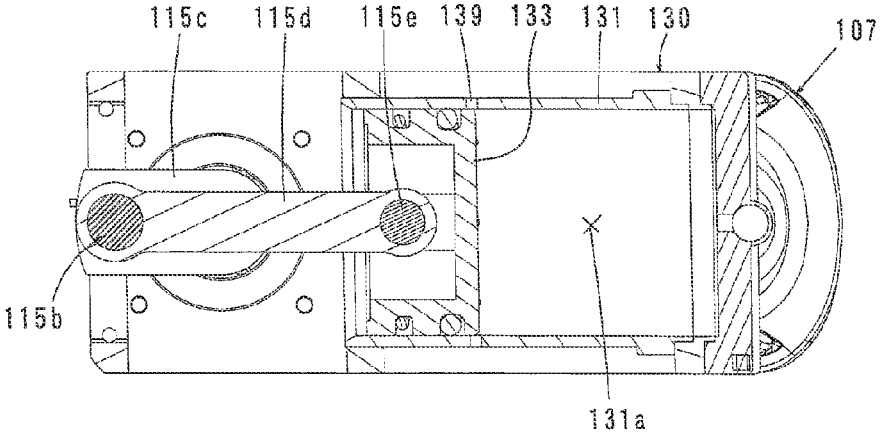
FIG. 5 is a sectional view taken along line C-C in FIG. 4 and showing the position of the compression piston when the crank angle (θ) is zero degrees (at bottom dead center).

As shown in FIG. 4, the driving cylinder 121 of the nail driving mechanism 120 and the compression cylinder 131 of the compression device 130 extend in a front-rear direction of the nailer 100 and are arranged in parallel to each other.

A driving piston 123 that strikes a nail is housed in a cylinder chamber 121*a* of the driving cylinder 121 such that it can slide in a longitudinal direction of the driving cylinder 121. The driving piston 123 includes a piston body 124 that is housed so as to be slidable within the cylinder chamber 121*a*, and an elongate driver 125 that is integrally formed with the piston body 124 and drives the nail. The driving piston 123 linearly moves in the longitudinal direction of the driving cylinder 121; the driver 125 moves forward within the driving passage 141*a* of the driver guide 141 and drives the nail. The driving piston 123, the piston body 124 and the driver 125 are example embodiments that correspond to the "first piston", the "sliding part" and the "driving part", respectively, according to the present invention. The nail driving mechanism 120 is constituted by the driving cylinder 121 and the driving piston 123.

The compression cylinder 131 of the compression device 130 is configured as a cylindrical member having a larger diameter and a shorter longitudinal length than the driving cylinder 121. A region in front of the compression cylinder 131 is defined as an installation space for a crank mechanism 115. A compression piston 133 is housed in the compression cylinder 131 of the compression device 130 such that it can slide in a longitudinal direction of the compression cylinder 131. The compression piston 133 is driven by the electric motor 111 via the crank mechanism 115. The compression piston 133 is an example embodiment that corresponds to the "second piston" according to the present invention.

As shown in FIG. 4, the electric motor 111 is disposed in the driving part housing 109 such that its rotation axis intersects with the longitudinal direction of the compression cylinder 131. The speed of rotation of the electric motor 111 is reduced by the planetary gear type, speed reducing mechanism and then the rotation is transmitted to the crank mechanism 115 serving as a motion converting mechanism, which is disposed in front of the compression cylinder 131. The rotation of the electric motor 111 is converted into linear motion by the crank mechanism 115, which causes the compression piston 133 to linearly reciprocate. As a result, the volume of the compression chamber 131*a*, which is the internal space of the compression cylinder 131, is changed and the compression piston 133 moves in the rightward direction, so that the volume of the compression chamber 131*a* is reduced and air in the compression chamber 131*a* is compressed. Specifically, a reciprocating compression device that mainly includes the compression cylinder 131, the compression piston 133 and the crank mechanism 115 is configured and serves as the compression device 130. The electric motor 111 is an example embodiment that corresponds to the "motor" according to the present invention.

The crank mechanism 115 mainly includes a crank shaft 115*a*, a crank pin 115*b*, a crank plate 115*c* and a connecting rod 115*d*. The crank shaft 115*a* is rotated by the speed reducing mechanism. The crank pin 115*b* is provided at a position displaced from the center of rotation of the crank shaft 115*a*. The crank plate 115*c* connects the crank shaft 115*a* and the crank pin 115*b*. One end of the connecting rod 115*d* is connected to the crank pin 115*b* such that it can rotate with respect to the crank pin 115*b*, and the other end is connected to the compression piston 133 via a connecting pin 115*e* such that it can rotate with respect to the compression piston 133. The crank mechanism 115 is housed within the body housing 107 in front of the compression cylinder 131.

When a trigger switch is actuated by depressing a trigger 103*a* provided on the handle 103 and a contact arm switch is actuated by pressing the driver guide 141, which serves as a contact arm and is provided in the front end region of the body 101, against the workpiece, the electric motor 111 is energized. On the other hand, when either one or both of the trigger 103*a* and the driver guide 141 are not actuated, the electric motor 111 is stopped.

As shown in FIG. 4, an air passage 135, which provides communication between the compression chamber 131*a* of the compression cylinder 131 and the driving cylinder 121, and a valve 137 (also referred to as a mechanical valve), which provides and cuts off communication between the compression chamber 131*a* of the compression cylinder 131 and the driving cylinder 121, are provided in the body housing 107. Specifically, the valve 137 is configured to open and close the air passage 135. The air passage 135 and the valve 137 are example embodiments that correspond to the "compressed air supply passage" and the "valve member", respectively, according to the present invention. When the driving piston 123 is moved to a rear end position (to the right as viewed in FIG. 4) and the compression piston 133 is moved to a front end position (bottom dead center) as shown in FIG. 4, the nailer 100 is defined as being located in the initial position. Specifically, the position where the crank angle (θ) is zero degrees is defined as the initial position.

As shown in FIG. 4, the valve 137 is disposed on the rear end (right end as viewed in FIG. 4) of the driving cylinder 121 such that it can move back and forth on the same axis as a driving line of the driver 125 of the driving piston 123. When the valve 137 moves rearward, the valve 137 opens the air passage 135 and provides communication between the compression chamber 131*a* and the cylinder chamber 121*a*. When the valve 137 moves forward, the valve 137 closes the air passage 135 and cuts off the communication between the compression chamber 131*a* and the cylinder chamber 121*a*. The valve 137 is configured as a mechanical valve that is controlled by a cam mechanism 151 interlocked with the crank mechanism 115. The valve 137 is provided to open the air passage 135 when the compression piston 133 is moved rearward to the vicinity of the top dead center. Therefore, when the valve 137 opens the air passage 135, the compressed air in the compression chamber 131*a* is supplied into the cylinder chamber 121*a* of the driving cylinder 121. As a result, the driving piston 123 is moved forward by the compressed air and the driver 125 strikes the nail and drives it into the workpiece. Further, in order to be mechanically connected with the cam mechanism 151, the valve 137 is disposed such that its rear end portion protrudes to the outside of the driving cylinder 121.

Figure 8:
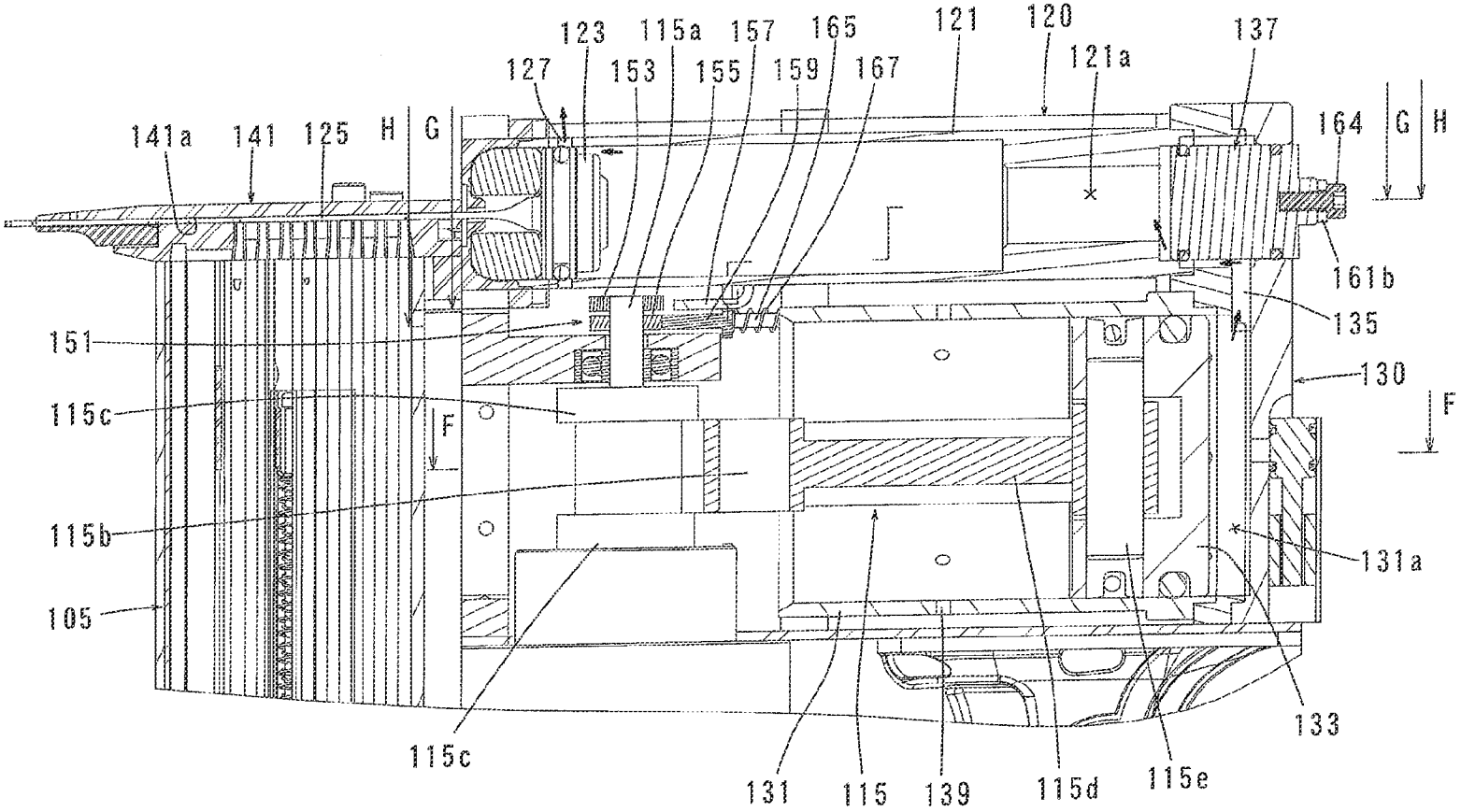
FIG. 8 is a sectional view for showing the positional relationship between the compression piston, the driving piston and the valve when the crank angle (θ) is 180 degrees (at top dead center).
Figure 9:
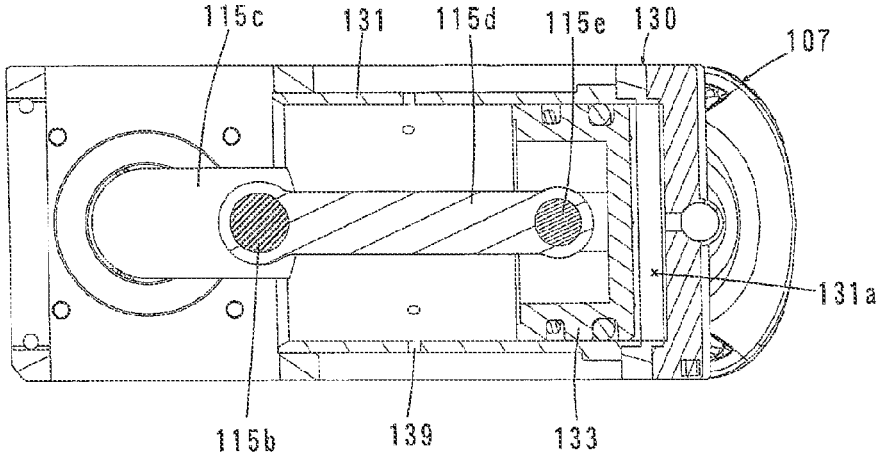
FIG. 9 is a sectional view taken along line F-F in FIG. 8 and showing the position of the compression piston when the crank angle (θ) is 180 degrees (at top dead center).
Figure 10:
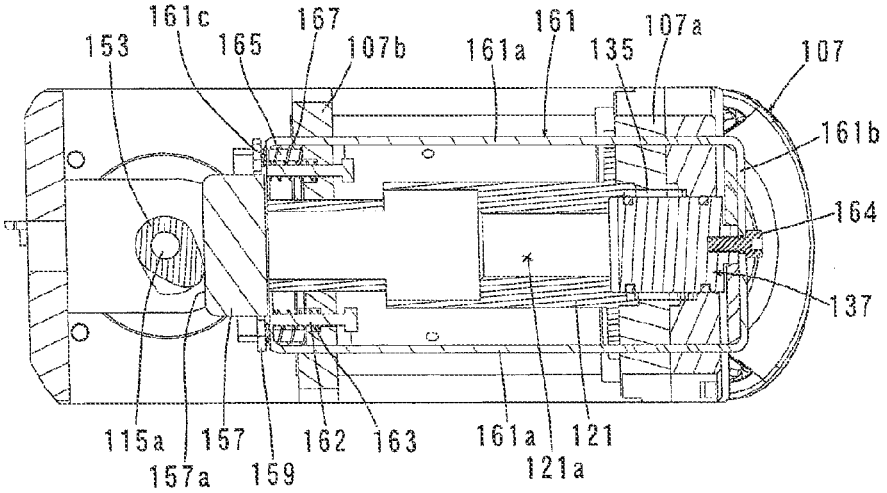
FIG. 10 is a sectional view taken along line G-G in FIG. 8 and showing the operating status of the first cam plate when the crank angle (θ) is 180 degrees (at top dead center).
Figure 11:
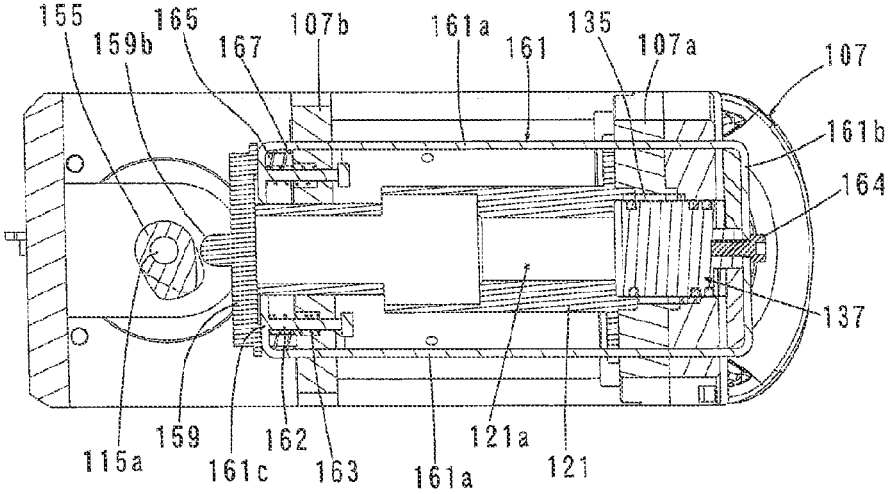
FIG. 11 is a sectional view taken along line H-H in FIG. 8 and showing the operating status of the second cam plate when the crank angle (θ) is 180 degrees (at top dead center).

As shown in FIG. 8, the driving cylinder 121 has a through hole 127 for discharging the compressed air to the atmosphere upon or immediately before completion of the nail driving operation. The through hole 127 is provided at a position where the internal space of the driving cylinder 121 communicates with the atmosphere when the driving piston 123 is moved to the front end position. Specifically, it is configured such that the cylinder chamber 121*a* of the driving cylinder 121 communicates with the atmosphere at the same time when the nail driving operation of the driver 125 is completed.

Figure 12:
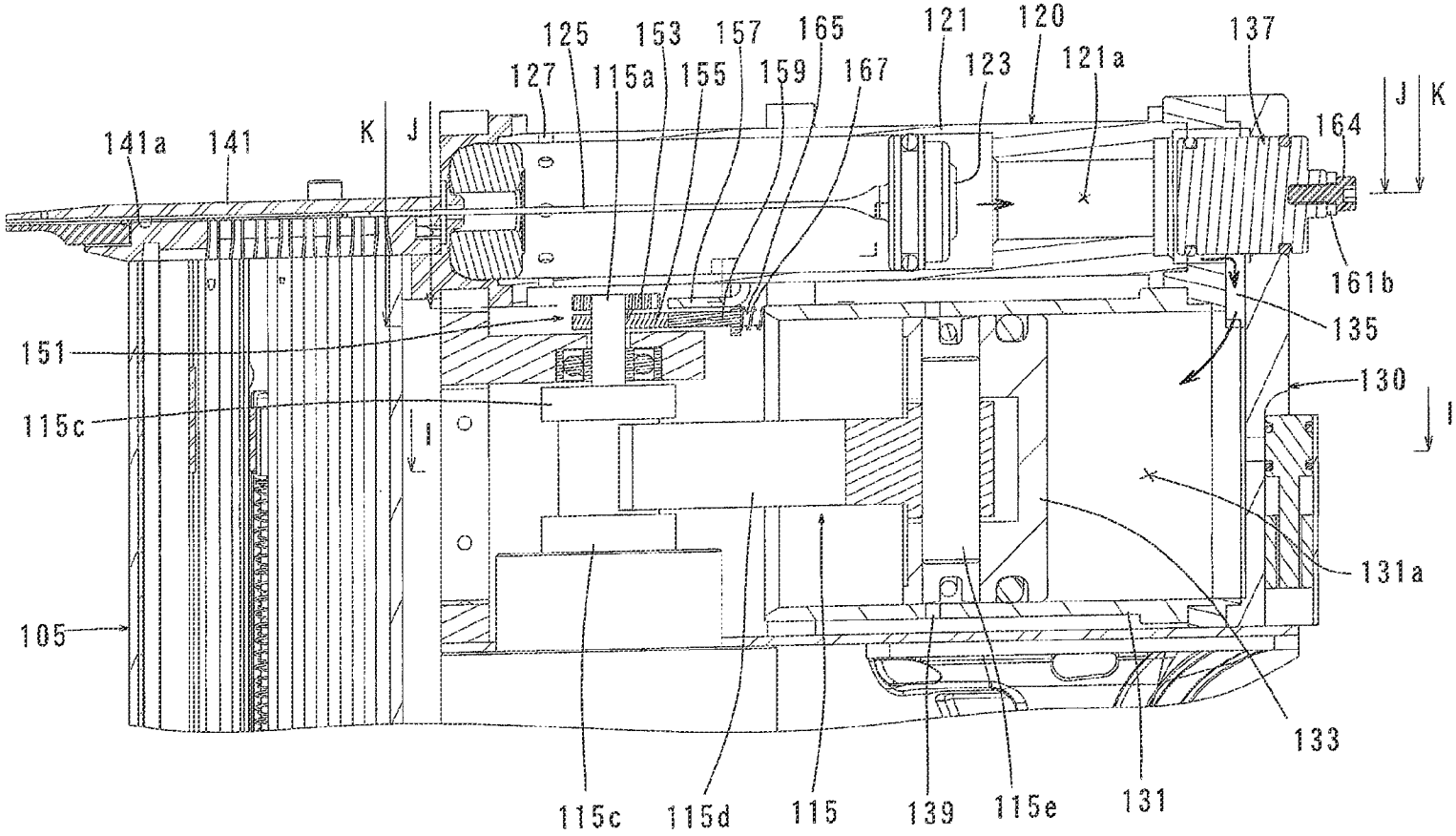
FIG. 12 is a sectional view showing positional relationship between the compression piston, the driving piston and the valve when the crank angle (θ) is 270 degrees.
Figure 13:
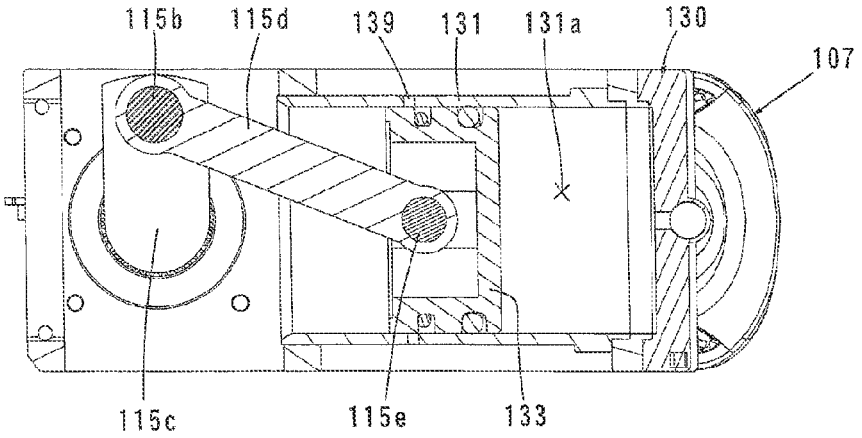
FIG. 13 is a sectional view taken along line I-I in FIG. 12 and showing the position of the compression piston when the crank angle (θ) is 270 degrees.
Figure 14:
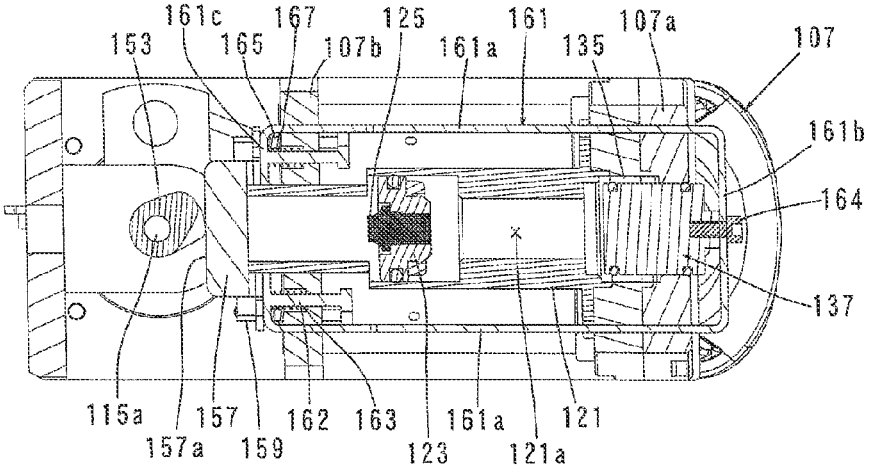
FIG. 14 is a sectional view taken along line J-J in FIG. 12 and showing the operating status of the first cam plate when the crank angle (θ) is 270 degrees.
Figure 15:
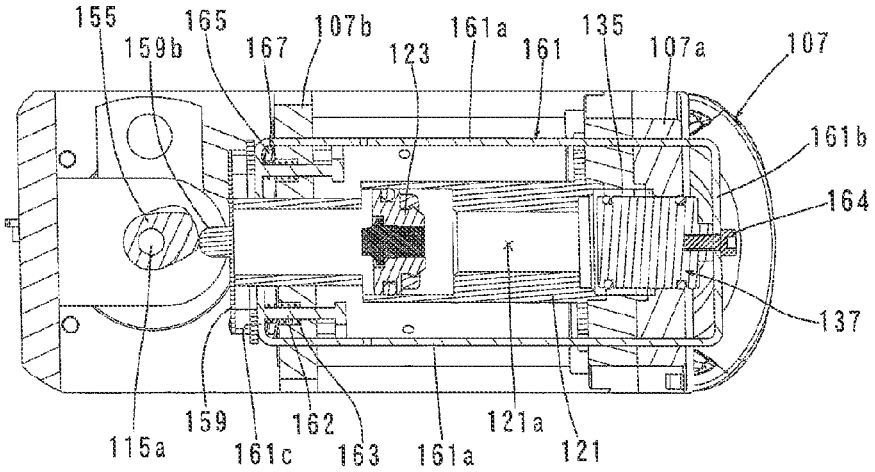
FIG. 15 is a sectional view taken along line K-K in FIG. 12 and showing the operating status of the second cam plate when the crank angle (θ) is 270 degrees.
Figure 16:
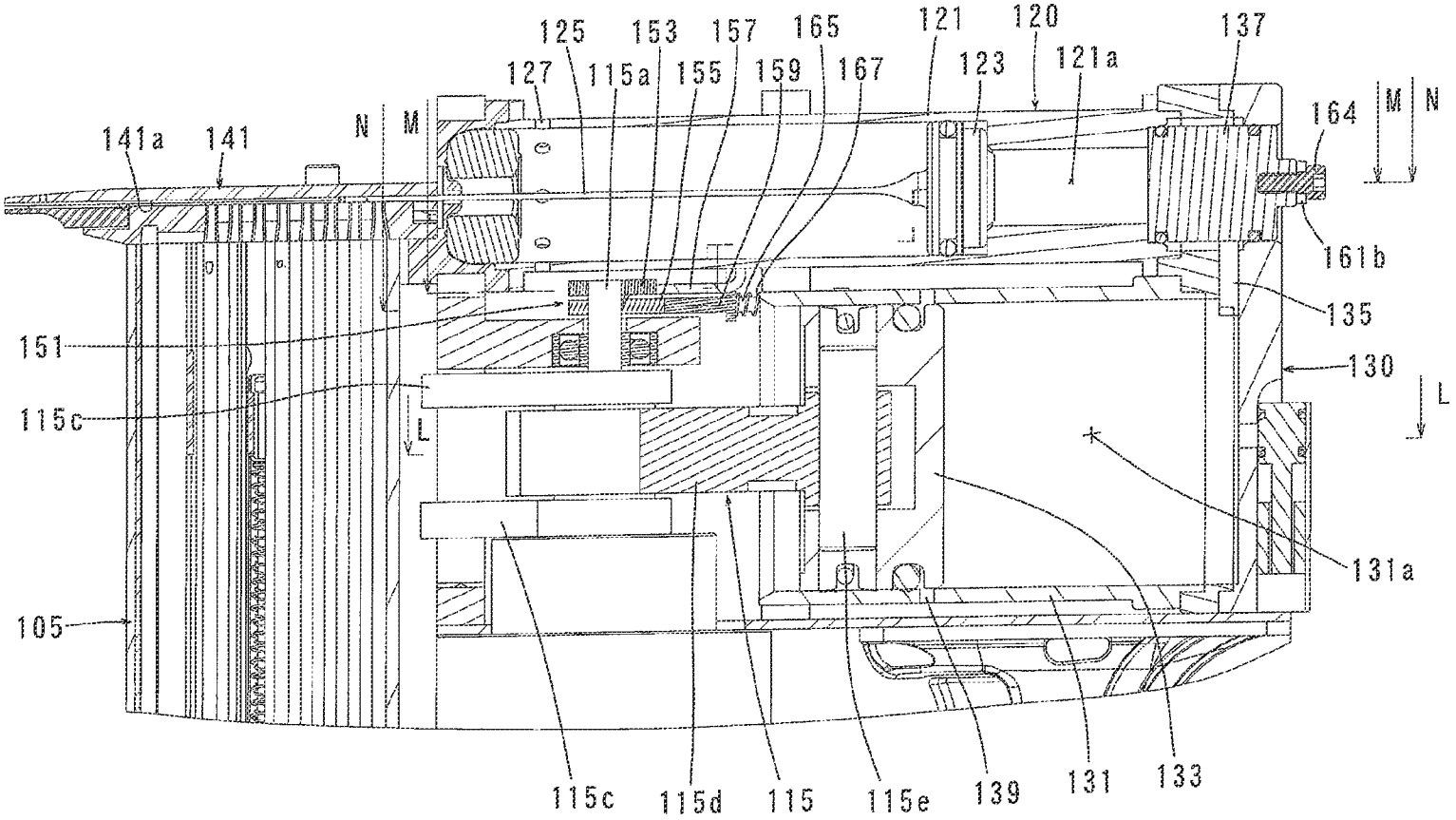
FIG. 16 is a sectional view showing the positional relationships of the compression piston, the driving piston and the valve when the crank angle (θ) is 330 degrees.
Figure 17:
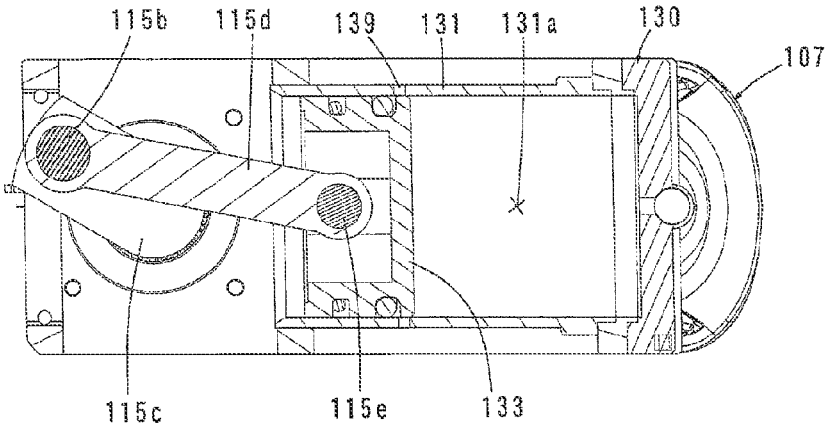
FIG. 17 is a sectional view taken along line L-L in FIG. 16 and showing the position of the compression piston when the crank angle (θ) is 330 degrees.
Figure 18:
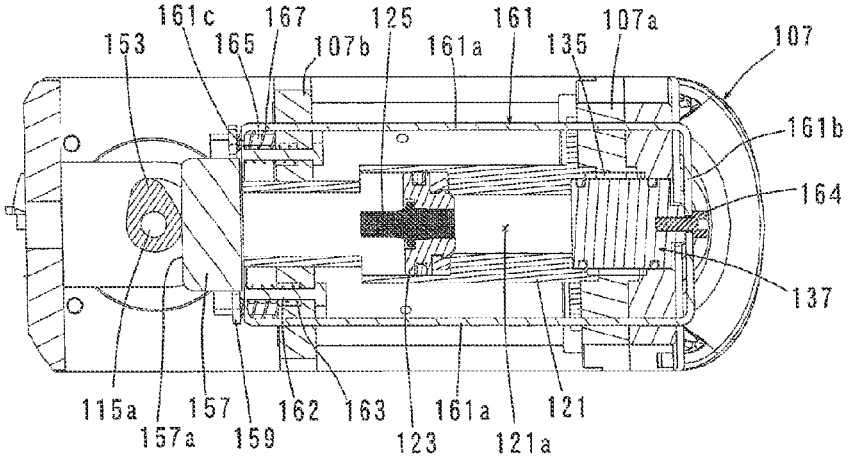
FIG. 18 is a sectional view taken along line M-M in FIG. 16 and showing the operating status of the first cam plate when the crank angle (θ) is 330 degrees.
Figure 19:
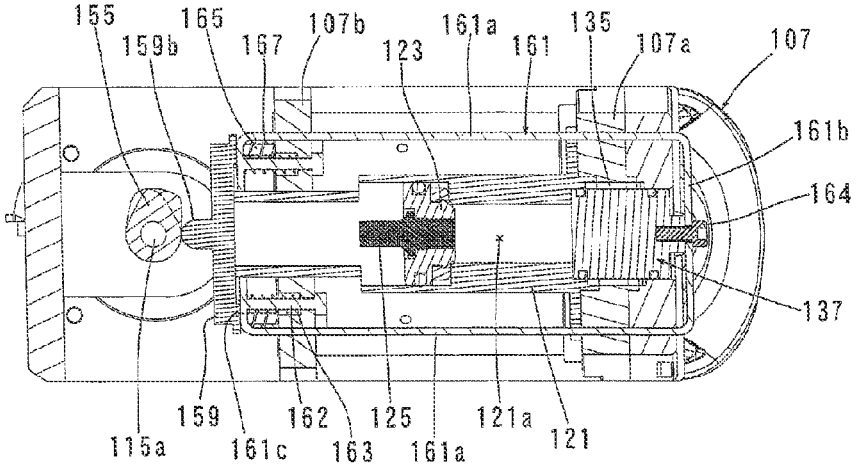
FIG. 19 is a sectional view taken along line N-N in FIG. 16 and showing the operating status of the second cam plate when the crank angle (θ) is 330 degrees.

As shown in FIG. 12, when the compression piston 133 is moved forward (toward the bottom dead center) after the compressing operation, the volume of the compression chamber 131*a* is increased so that the pressures in the compression chamber 131*a* and the driving cylinder 121 are reduced. Therefore, the driving piston 123 is moved rearward by the reduction of the pressure of the compression chamber 131*a*. Further, the compression cylinder 131 has an atmosphere communication port 139 that provides communication between the atmosphere and the compression chamber 131*a* when the compression piston 133 comes close to the initial position or the front end position (bottom dead center). The valve 137 closes the air passage 135 by the time when the compression piston 133 reaches the front end position (bottom dead center) after passing the atmosphere communication port 139. In this manner, the driver 125 of the driving piston 123 performs one cycle of the nail driving operation by one stroke of the compression piston 133.

The cam mechanism 151 that controls the valve 137 will now be explained. As shown in FIG. 1, the cam mechanism 151 mainly includes a first cam plate 153, a second cam plate 155, a first cam follower 157, a second cam follower 159 and a motion transmitting member 161. Each of the first cam plate 153 and the second cam plate 155 comprises a plate cam. The first cam follower 157 is held in contact with an outer circumferential surface of the first cam plate 153 and converts rotation of the first cam plate 153 into linear motion in the front-rear directions. The motion transmitting member 161 transmits linear motion of the first cam follower 157 and the second cam follower 159 to the valve 137. The first cam plate 153 and the second cam plate 155 are example embodiments that correspond to the "cam member" according to the present invention. Further, the motion transmitting member 161 is an example embodiment that corresponds to the "relay member" according to the present invention.

As shown in FIGS. 1 and 4, the first cam plate 153 and the second cam plate 155 are disposed under the driving cylinder 121 and in front of the compression cylinder 131, and are mounted side by side on the crank shaft 115*a* such that they rotate together with the crank shaft 115*a*. The first cam plate 153 is configured as an actuating cam for actuating the valve 137 to open the air passage 135. The second cam plate 155 is configured as a retaining cam that holds the position of the valve 137 for a prescribed period of time after the valve 137 is moved by the first cam plate 153.

Figure 3:
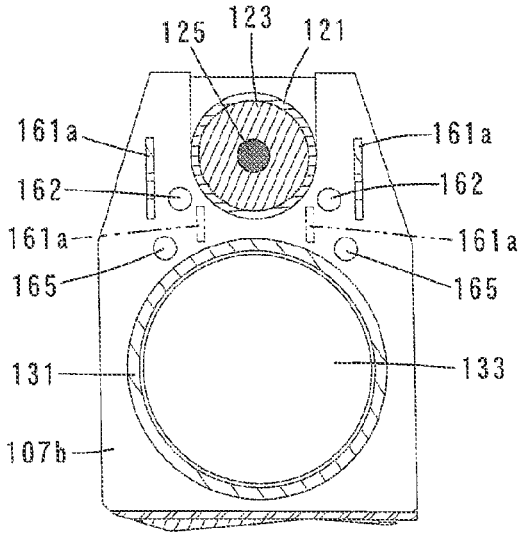
FIG. 3 is a sectional view taken along line B-B in FIG. 1.
Figure 6:
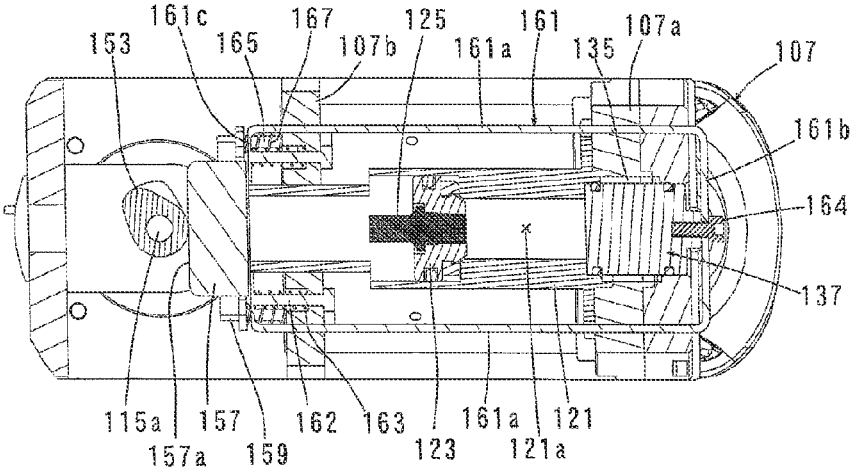
FIG. 6 is a sectional view taken along line D-D in FIG. 4 and showing the operating status of a first cam plate when the crank angle (θ) is zero degrees (at bottom dead center).

The motion transmitting member 161 is formed in a substantially rectangular frame shape which is elongated in the front-rear direction, and mainly includes side parts 161*a*, a rear part 161*b* and a front part 161*c* as shown in FIGS. 1, 3 and 6. The side parts 161*a* are elongate members which are arranged to extend in the front-rear direction along right and left sides of the driving cylinder 121. The rear part 161*b* is connected to the rear end of the valve 137 by a screw 164. The front part 161*c* is connected to the first cam follower 157. Further, as shown in FIG. 6, the side parts 161*a* are disposed to extend through both a rear connecting plate 107*a* and a front connecting plate 107*b*, which are provided as components of the body housing 107 and connect the driving cylinder 121 and the compression cylinder 131. As described above, the motion transmitting member 161 is disposed between an outer wall of the cylinder chamber 121*a* and an outer wall of the compression chamber 131*a*.

Figure 7:
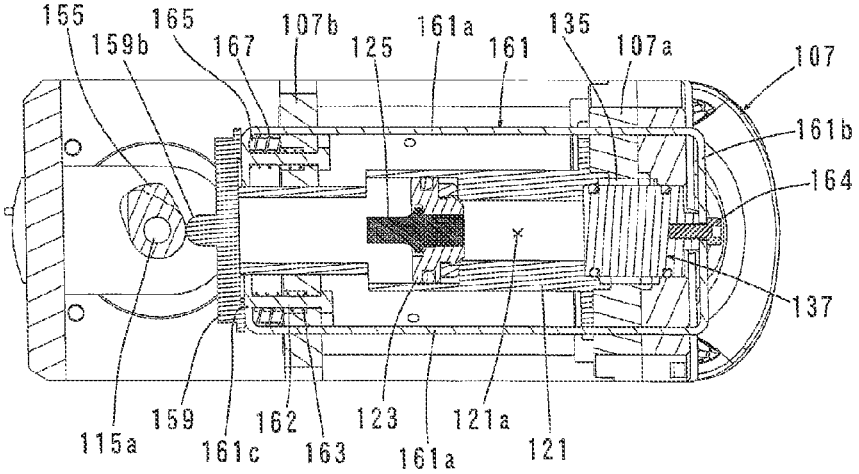
FIG. 7 is a sectional view taken along line E-E in FIG. 4 and showing the operating status of a second cam plate when the crank angle (θ) is zero degrees (at bottom dead center).

As shown in FIG. 1, the first cam follower 157 is configured as a plate-shaped member and extends forward from a lower end of the front part 161*c*. A front end surface of the first cam follower 157 opposes an outer circumferential surface of the first cam plate 153. Furthermore, as shown in FIG. 6, a contact surface of the first cam follower 157 in contact with the first cam plate 153 is configured as a flat surface 157*a*. As shown in FIGS. 6 and 7, two first guide rods 162 are provided on the front part 161*c* and extend rearward in parallel to each other. Each of the first guide rods 162 is inserted through the front connecting plate 107*b* of the body housing 107 such that they are movable in the front-rear directions. Thereby, the motion transmitting member 161 and the first cam follower 157 are stably moved in the front-rear directions.

As shown in FIGS. 6 and 7, the motion transmitting member 161 is constantly biased by two first coil springs 163 in a direction that holds the first cam follower 157 in contact with the first cam plate 153. The two first coil springs 163 are respectively fitted onto the first guide rods 162 and are disposed between the front part 161*c* of the motion transmitting member 161 and the front connecting plate 107*b* of the body housing 107. The two first coil springs 163 are disposed symmetrically with respect to a straight line passing through a rotation center of the first cam plate 153 and extending in the front-rear direction.

Figure 2:
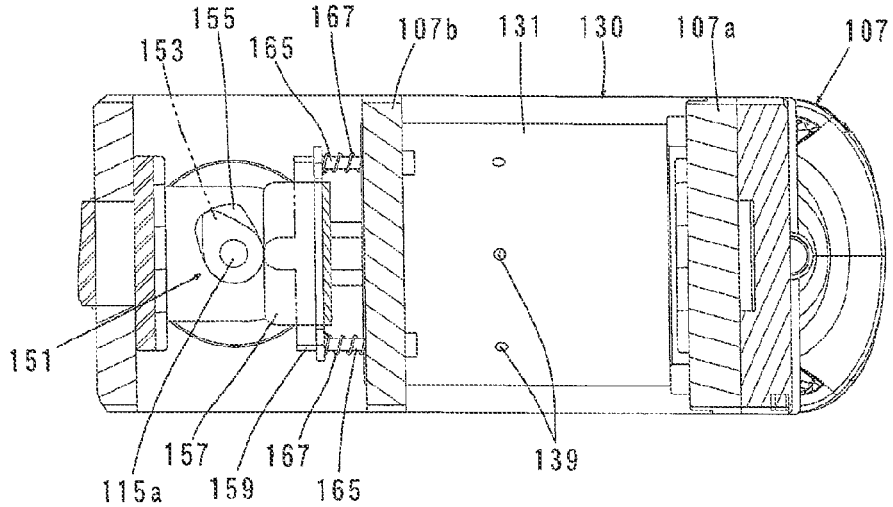
FIG. 2 is a sectional view taken along line A-A in FIG. 1.

As shown in FIGS. 1, 2, 6 and 7, the second cam follower 159 is formed as a plate-shaped member and is formed as a separate member from the motion transmitting member 161. Further, the second cam follower 159 has a protruding part 159*a* (see FIG. 1) extending upward, and the protruding part 159*a* is disposed such that its rear surface can come into contact with a front surface of the front part 161*c* of the motion transmitting member 161. As shown in FIG. 2, the second cam follower 159 has two second guide rods 165 which project rearward from a rear surface of the protruding part 159*a*. Each of the second guide rods 165 is inserted through the front connecting plate 107*b* of the body housing 107 such that they are movable in the front-rear directions. Thereby, the second cam follower 159 is stably moved in the front-rear directions.

Further, the second cam follower 159 is constantly biased by two second coil springs 167 in a direction that holds the second cam follower 159 in contact with the second cam plate 155. The two second coil springs 167 are respectively fitted onto the second guide rods 165 and are disposed between the protruding part 159*a* and the front connecting plate 107*b* of the body housing 107. Further, as shown in FIG. 2, the second coil springs 167 are disposed symmetrically with respect to a straight line passing through a rotation center of the second cam plate 155 and extending in the front-rear direction. As shown in FIG. 7, the second cam follower 159 has a contact part 159*b* having a curved surface which is held in contact with the second cam plate 155.

Figure 20:
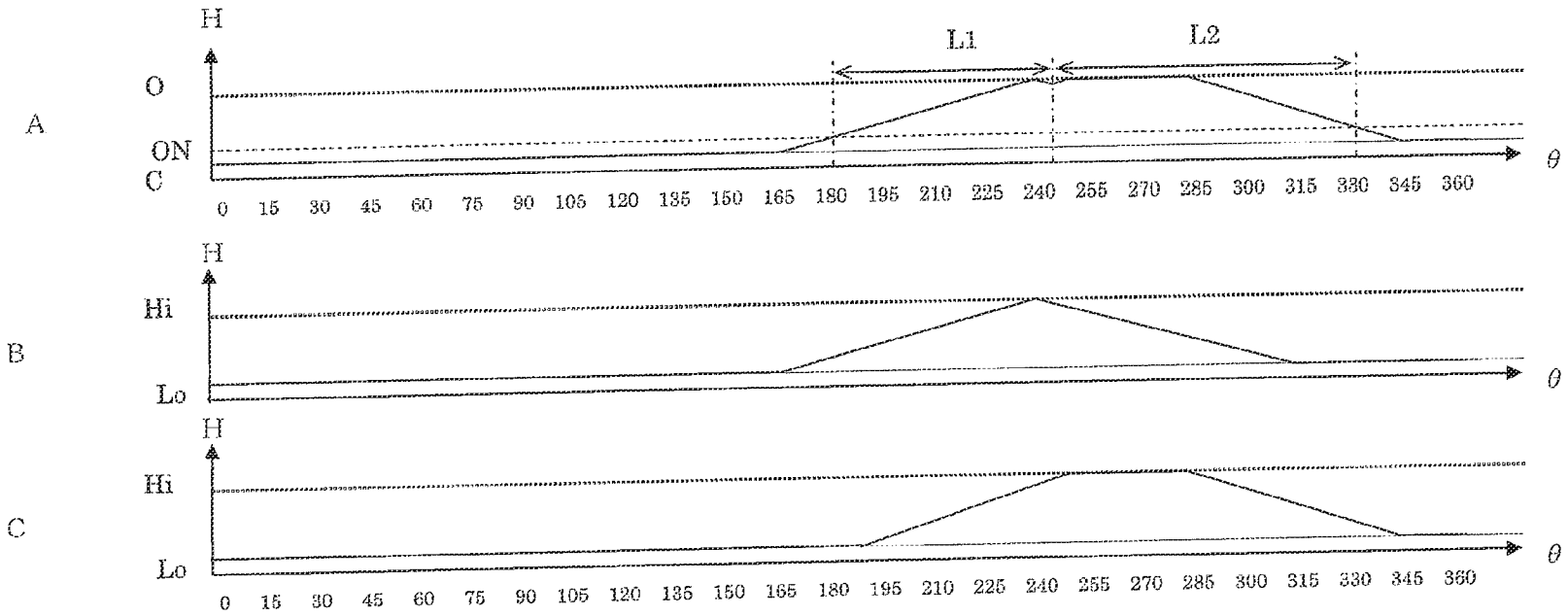
FIG. 20 is graphs showing the operation of the valve that is opened and closed by the first cam plate and the second cam plate.
Figure 21:
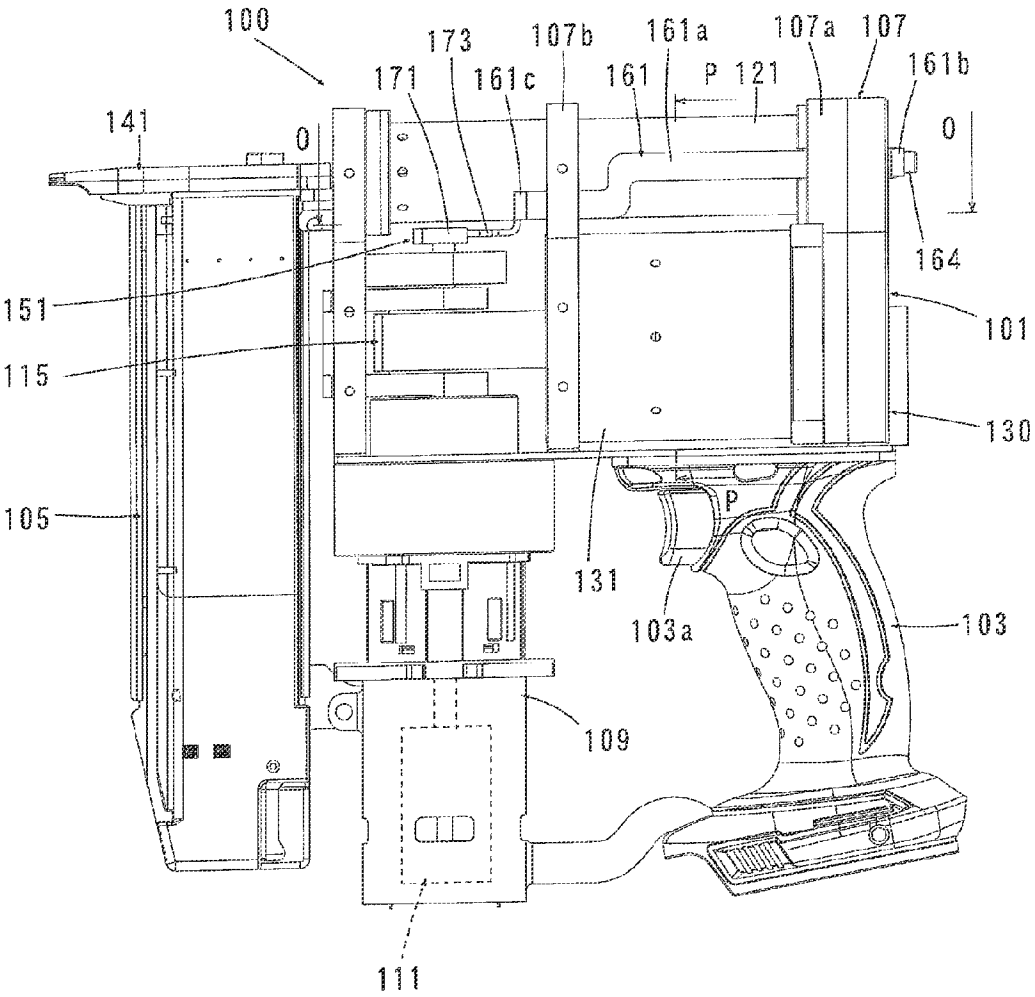
FIG. 21 is an external view showing the overall structure of a nailer according to a modification of the present invention.
Figure 22:
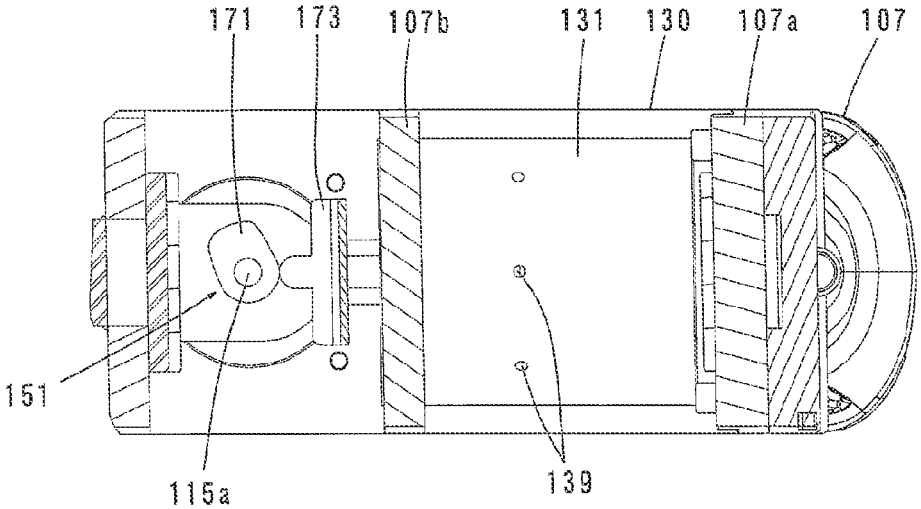
FIG. 22 is a sectional view taken along line O-O in FIG. 21.
Figure 23:
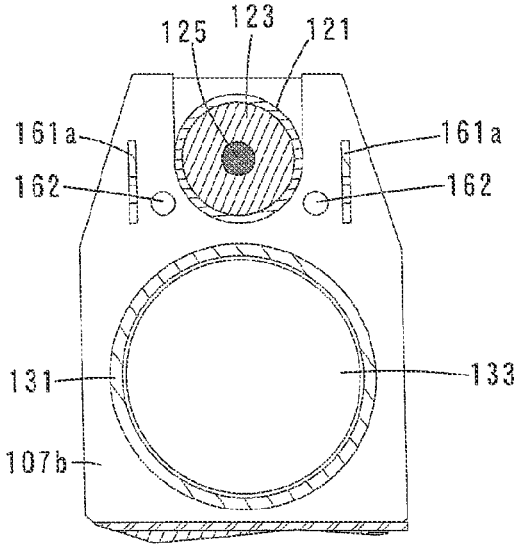
FIG. 23 is a sectional view taken along line P-P in FIG. 21.

FIG. 20 shows the operation of the valve 137, and the crank angle (θ) of the compression piston 133 is shown on the horizontal axis. In graph A, the amount of travel (H) of the valve 137 is shown on the vertical axis. Graphs B and C show the amounts of lift (H) of the first cam plate 153 and the second cam plate 155, respectively. Further, in FIG. 20, the region where the valve 137 opens the air passage 135 via the first cam plate 153 is designated by L1 and the region where the valve 137 opens the air passage 135 via the second cam plate 155 is designated by L2. In graph A, the state in which the air passage 135 is closed by the valve 137 is designated by C and the state in which the air passage 135 is completely opened by the valve 137 is designated by O. The state of the valve at the beginning of opening (closing) the air passage 135 is designated by ON. In graphs B and C, the minimum and maximum amounts of the cam lift of the first cam plate 153 and the second cam plate 155 are designated by Lo and Hi, respectively.

As shown in FIG. 20, the position where the crank angle (θ) is zero degrees (360 degrees) is set as the initial position. The first cam plate 153 is designed such that its cam lift amount (H) starts to linearly increase at the crank angle (θ) of about 165 degrees and reaches its peak at the crank angle (θ) of about 240 degrees and then linearly decreases until the crank angle (θ) reaches about 315 degrees. The second cam plate 155 is designed such that its cam lift amount (H) starts to linearly increase at the crank angle (θ) of about 190 degrees and reaches its maximum at the crank angle (θ) of about 240 degrees, and thereafter starts to linearly decrease at about 285 degrees and reaches its minimum at about 345 degrees. The maximum cam lift amount of the second cam plate 155 is maintained in the range of the crank angle from about 240 to 285 degrees. Further, the minimum cam lift amount of the first cam plate 153 is set to be the same as that of the second cam plate 155. Therefore, the first cam follower 157 operates prior to the second cam follower 159.

Specifically, according to the cam lift amount (H) obtained by the combination of the first cam plate 153 and the second cam plate 155, the valve 137 is held to open the air passage 135 when the crank angle (θ) is in the range of about 180 to 330 degrees and to close the air passage 135 in the range outside of 180 to 330 degrees.

In the nailer 100 configured as described above, in the initial position as shown in FIGS. 4 to 7, when the contact arm switch is actuated by pressing the driver guide 141 against the workpiece and the trigger switch is actuated by depressing the trigger 103*a*, the electric motor 111 is energized. Thus the crank mechanism 115 is driven via the speed reducing mechanism and the compression piston 133 moves rearward and cuts off communication through the atmosphere communication port 139 between the compression chamber 131*a* and the atmosphere. At this time, as shown in FIG. 20, the valve 137 is held in a position to close the air passage 135 and the air in the compression chamber 131*a* is compressed.

When the compression piston 133 moves toward the top dead center and the crank angle (θ) exceeds about 165 degrees as shown in FIG. 20, the first cam plate 153 moves the first cam follower 157 rearward against the biasing force of the first coil spring 163. Thus, the motion transmitting member 161 is moved rearward together with the first cam follower 157. Therefore, the valve 137 moves rearward, and when the compression piston 133 reaches the vicinity of the top dead center (the crank angle (θ) of 180 degrees), the air passage 135 is opened. As shown in FIGS. 8 to 11, when the air passage 135 is opened, the compressed air in the compression chamber 131*a* is supplied into the cylinder chamber 121*a* of the driving cylinder 121 via the air passage 135. As a result, the valve 137 is moved to a rear position by the pressure of the compressed air supplied into the cylinder chamber 121*a*, and at the same time, the driving piston 123 is moved forward. Then the driver 125 of the driving piston 123 strikes the nail in the driving passage 141*a* of the driver guide 141 and drives the nail into the workpiece.

The compressed air in the cylinder chamber 121*a* is discharged to the atmosphere via the through hole 127 when the driver 125 drives the nail into the workpiece. Thereafter, the compression piston 133 moves forward. At this time, the valve 137 is located in the rear end position, and is held in the rear end position until the crank angle (θ) reaches about 330 degrees. Specifically, the air passage 135 is held open by the first cam plate 153 when the crank angle (θ) is in the range of about 180 to 240 degrees and held open by the second cam plate 155 when the crank angle (θ) is in the range of about 240 to 330 degrees.

When the compression piston 133 is moved forward, the air pressure in the compression chamber 131*a* is reduced. FIGS. 12 to 15 show the positional relationships of each member when the crank angle (θ) is about 270 degrees. As shown in FIG. 12, the air pressure in the compression chamber 131*a* acts on the driving piston 123 through the air passage 135 and the cylinder chamber 121*a*. By this pressure reduction, air in the cylinder chamber 121*a* is sucked into the compression chamber 131*a*, and the driving piston 123 is moved rearward.

As shown in FIGS. 16 to 19, when the crank angle (θ) exceeds 330 degrees, the driving piston 123 is returned to the initial position. Further, the valve 137 is moved forward together with the motion transmitting member 161 by the first coil spring 163 and closes the air passage 135. When the compression piston 133 is returned to the initial position or bottom dead center, the compression chamber 131*a* communicates with the atmosphere via the atmosphere communication port 139. Further, when the compression piston 133 is returned to the bottom dead center, the supply of current to the electric motor 111 is interrupted and the electric motor 111 is stopped even if the trigger switch and the contact arm switch are kept in the on state. One cycle of the nail driving operation is completed in this manner.

Interruption of the current supply to the electric motor 111 is controlled by a control device (not shown). For example, the control device has a position detection sensor (not shown) that detects the position of the crank pin 115*b* and is configured to control the electric motor 111 based on the result detected by the position detection sensor.

According to the above-described embodiment, the valve 137 is controlled according to the crank angle of the crank mechanism 115 by the cam mechanism 151 being mechanically connected to the crank mechanism 115 that drives the compression piston 133. Thereby, the problem of a time lag caused by a solenoid valve that is electrically controlled is prevented. That is, the control of the valve 137 is reliably executed. Therefore, by setting the amount of the cam lift such that the valve 137 opens the air passage 135 when the compression chamber 131*a* is in the maximum compressed state, the compressed air is rationally supplied into the cylinder chamber 121*a*.

In addition, according to this embodiment, because the opening of the air passage 135 is held by the valve 137 until the driving piston 123 of the cylinder chamber 121*a* completes the nail driving operation and returns to the initial position, the driving piston 123 is returned to the initial position by utilizing the reduced air pressure in the compression chamber 131*a*.

In addition, according to this embodiment, by controlling the valve 137 using the cam mechanism 151, the valve 137 is reliably controlled. Further, in this embodiment, because the valve 137 is controlled by the combination of the first and second cam plates 153, 155, the amount of the cam lift can be easily set. In addition, the opening timing of the air passage 135 by the valve 137 can be easily adjusted by controlling the circumferential direction positions of the first cam plate 153 and the second cam plate 155 relative to the crank shaft 115*a*.

In addition, according to this embodiment, because the first cam follower 157 is integrally formed with the motion transmitting member 161 and the second cam follower 159 is formed separately from the motion transmitting member 161, the shape of the contact surface of the first cam follower 157 in contact with the first cam plate 153 and the shape of the contact surface of the second cam follower 159 in contact with the second cam plate 155 can be individually designed according to the respective shapes of the cam plates.

In addition, according to this embodiment, because the motion transmitting member 161 is disposed so as to extend in the front-rear direction alongside the lateral side of the driving cylinder 121, the motion transmitting member 161 is rationally disposed. Furthermore, as a modification to the arrangement of the motion transmitting member 161, the right and left side parts 161*a*, which are arranged in a position shown by solid line in FIG. 3 in this embodiment, may be modified to be arranged in the position shown by the two-dot chain line in FIG. 3. That is, the motion transmitting member 161 may be arranged to extend in the front-rear direction between the outer walls of the driving cylinder 121 and the compression cylinder 131. According to the modification, the motion transmitting member 161 can be more efficiently arranged, which is effective in reducing the size of the body 101.

In addition, according to this embodiment, because the valve 137 is disposed coaxially with the driver 125 and moves in the same direction as the motion transmitting member 161, the control of the valve 137 can be rationally performed. In addition, because the motion transmitting member 161 is formed in a substantially rectangular frame shape and is connected to the valve 137 at the middle in the transverse direction crossing the direction of movement of the motion transmitting member 161, the motion transmitting member 161 and the valve 137 can be smoothly moved.

Figure 24:
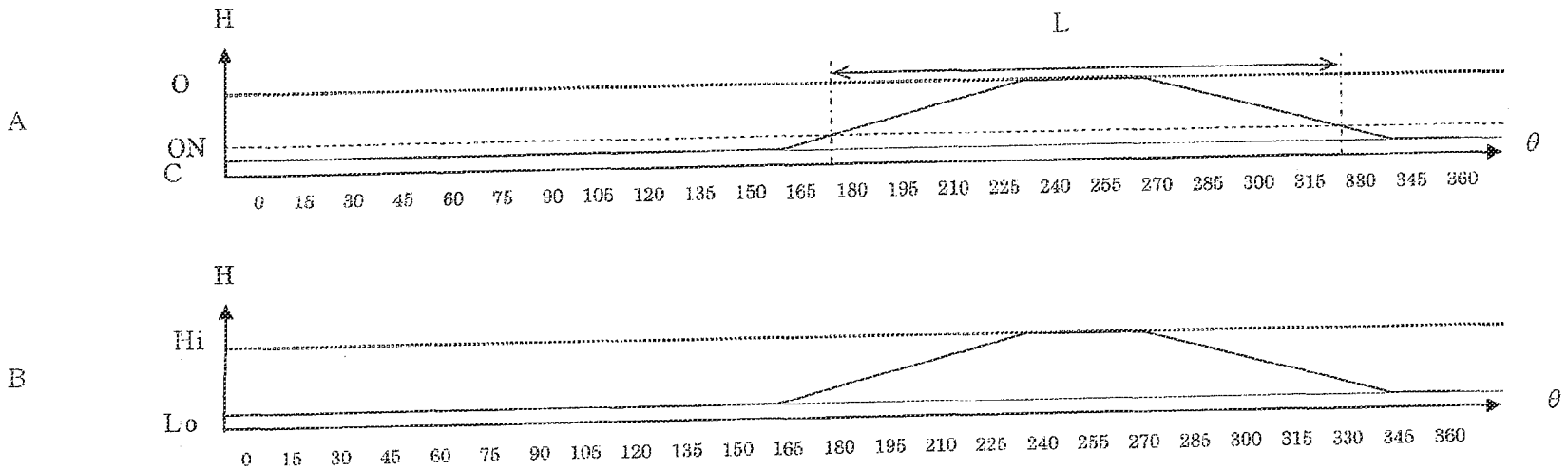
FIG. 24 is graphs showing the operation of the valve according to the modification.

A modification to this embodiment will now be explained with reference to FIGS. 21 to 24. The modification relates to the valve-controlling cam mechanism 151. In the modification, the valve is controlled by using a single third cam plate 171. That is, the cam mechanism 151 is constituted by the third cam plate 171, which is fitted onto the crank shaft 115*a*, a third cam follower 173, which converts rotation of the third cam plate 171 into linear motion in the front-rear directions, and the motion transmitting member 161, which transmits the linear motion of the third cam follower 173 to the valve (not shown). Furthermore, the motion transmitting member 161 is integrally formed with the third cam follower 173. FIG. 24 is graphs showing the operation of the valve, and the crank angle (θ) is shown on the horizontal axis. In graph A, the amount of travel (H) of the valve is shown on the vertical axis. Graph B shows the amount of lift (H) of the third cam plate 171. Further, the region where the valve opens the air passage 135 via the third cam plate 171 is designated by L. Furthermore, other than the above-described structure, it is the same structure as the first embodiment, and the other components are given the same numerals as in the first embodiment and are not described.

In the modification, because the valve is controlled by using the single third cam plate 171, the timing when the valve opens the air passage 135 is arbitrarily set by adjusting the cam shape. That is, as shown in FIG. 24, the cam shape of the third cam plate 171 is set such that the amount of cam lift of the third cam plate 171 is substantially equal to the amount of cam lift set by the combination of the first cam plate 153 and the second cam plate 155 in the first embodiment. Therefore, like the first embodiment, the valve can be controlled by the cam mechanism 151 according to the crank angle, so that this modification has substantially the same effects as the first embodiment.

Second Embodiment

Figure 25:
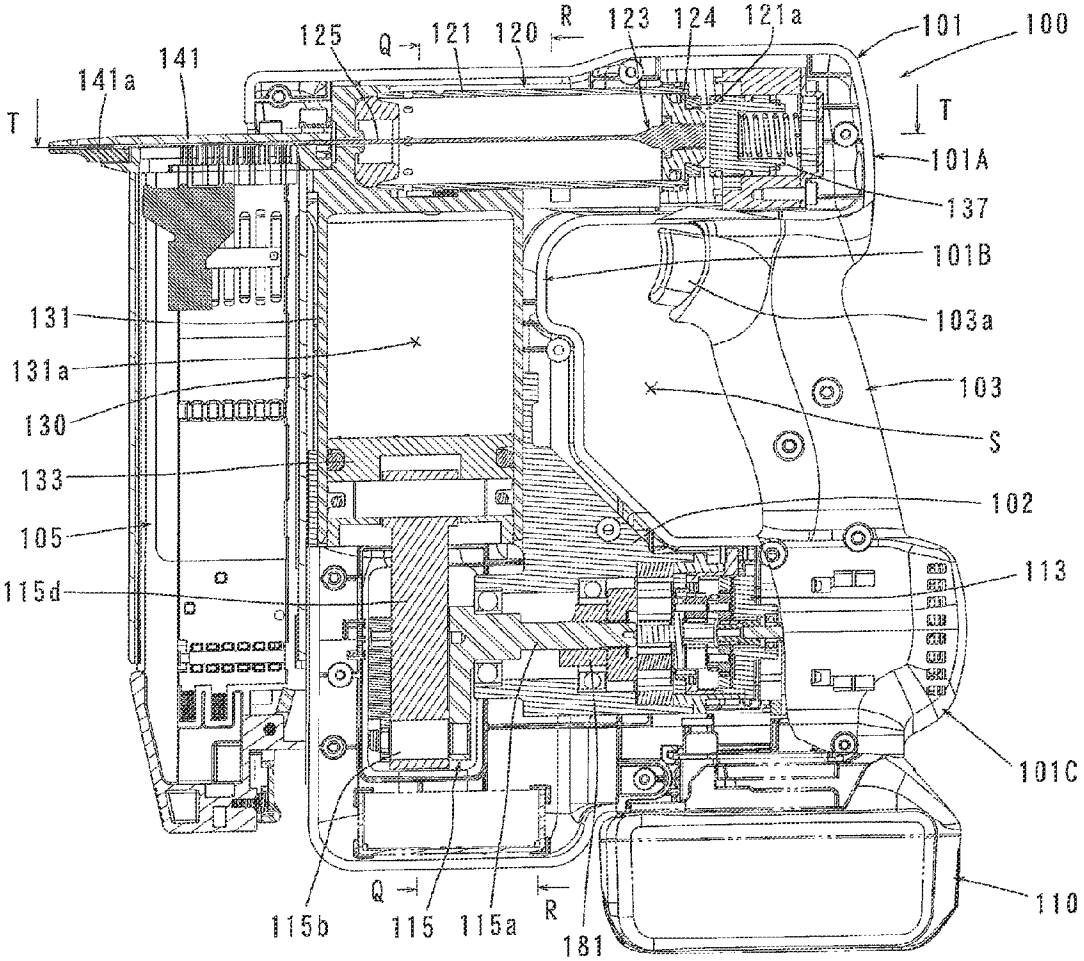
FIG. 25 is a sectional view showing the overall structure of a nailer according to a second embodiment of the invention.

A second embodiment will now be explained with reference to FIGS. 25 to 33. A nailer 100 according to the second embodiment differs in the arrangement of the components from the nailer 100 of the first embodiment. Therefore, components which are substantially identical to those in the first embodiment are given the same numerals as in the first embodiment. As shown in FIG. 25, the nailer 100 mainly includes the body 101 serving as the tool body and the magazine 105 that stores nails (not shown) serving as struck materials to be driven into a workpiece.

The body 101 is formed by joining together a pair of substantially symmetrical housings. The body 101 integrally has the handle 103 to be held by a user, a driving mechanism housing part 101A for housing the nail driving mechanism 120, a compression device housing part 101B for housing the compression device 130 and a motor housing part 101C for housing the electric motor 111 (see FIG. 29). The handle 103, the driving mechanism housing part 101A, the compression device housing part 101B and the motor housing part 101C are arranged to form a generally quadrilateral shape having these four parts as its respective sides. Thus, an approximately quadrilateral space S is defined by the four components.

The handle 103 is an elongate member having a prescribed length; one end of the handle 103 in its extending direction is connected to one end region of the driving mechanism housing part 101A and the other end in its extending direction is connected to one end region of the motor housing part 101C. The compression device housing part 101B is arranged to extend substantially in parallel to the handle 103; one end of the compression device housing part 101B in its extending direction is connected to the other end region of the driving mechanism housing part 101A and the other end region in its extending direction is connected to the other end region of the motor housing part 101C. Thus, the handle 103, the driving mechanism housing part 101A, the compression device housing part 101B and the motor housing part 101C define an approximately quadrilateral space S.

FIG. 25 shows the nail driving direction (discharge direction) in which a nail is driven in the leftward direction in FIG. 25 through the driver guide 141 disposed at the front end (left end as viewed in FIG. 25) of the nailer 100. The nail driving direction is a nail striking direction in which the driver 125 strikes a nail. Further, for the sake of convenience of explanation, the front end side of the nailer 100 (the left as viewed in FIG. 25) is taken as the front or front side and its opposite side is taken as the rear or rear side. The side of a connection between the handle 103 and the driving mechanism housing part 101A (upper side as viewed in FIG. 25) is taken as the top or upper side and the side of a connection between the handle 103 and the motor housing part 101C (lower side as viewed in FIG. 25) is taken as the bottom or lower side.

The nail driving mechanism 120 housed in the driving mechanism housing part 101A mainly includes the driving cylinder 121 and the driving piston 123. The driving piston 123, the piston body 124 and the driver 125 are example embodiments that correspond to the "first piston", the "sliding part" and the "driving part", respectively, according to the present invention.

The compression device 130 housed in the compression device housing part 101B mainly includes the compression cylinder 131 and the compression piston 133 that is disposed in the compression cylinder 131 and can slide in the vertical direction. The compression piston 133 is an example embodiment that corresponds to the "second piston" according to the present invention.

The electric motor 111 housed in the motor housing part 101C is disposed such that its rotation axis extends substantially in parallel to an axis of the driving cylinder 121. Therefore, the rotation axis of the electric motor 111 is perpendicular to the sliding direction of the compression piston 133. Further, a battery mounting region is provided on a lower end of the motor housing part 101C, and a rechargeable battery pack 110 from which the electric motor 111 is powered is attached to this battery mounting region.

The speed of rotation of the electric motor 111 is reduced by the planetary gear type, speed reducing mechanism 113 and then the rotation is converted into linear motion by a crank mechanism 115 serving as motion converting mechanism and is transmitted to the compression piston 133. Further, the speed reducing mechanism 113 and the crank mechanism 115 are housed in an inner housing 102 (also referred to as a gear housing) which is provided in the compression device housing part 101B and the motor housing part 101C.

The electric motor 111 is controlled to start and stop by the trigger 103*a* provided on the handle 103 and by the driver guide 141 serving as a contact arm provided in a front end region of the body 101. That is, when the trigger 103*a* on the handle 103 is depressed to turn on a trigger switch 103*b* (see FIG. 29) and the driver guide 141 is pressed against the workpiece so as to be moved rearward and turn on a contact arm switch 143 (see FIG. 30), the electric motor 111 is energized. On the other hand, when either one or both of the trigger 103*a* and the driver guide 141 are not actuated, the electric motor 111 is stopped. Further, the driver guide 141 is biased to the front side (forward) by a biasing spring 142 (see FIG. 30).

Figure 26:
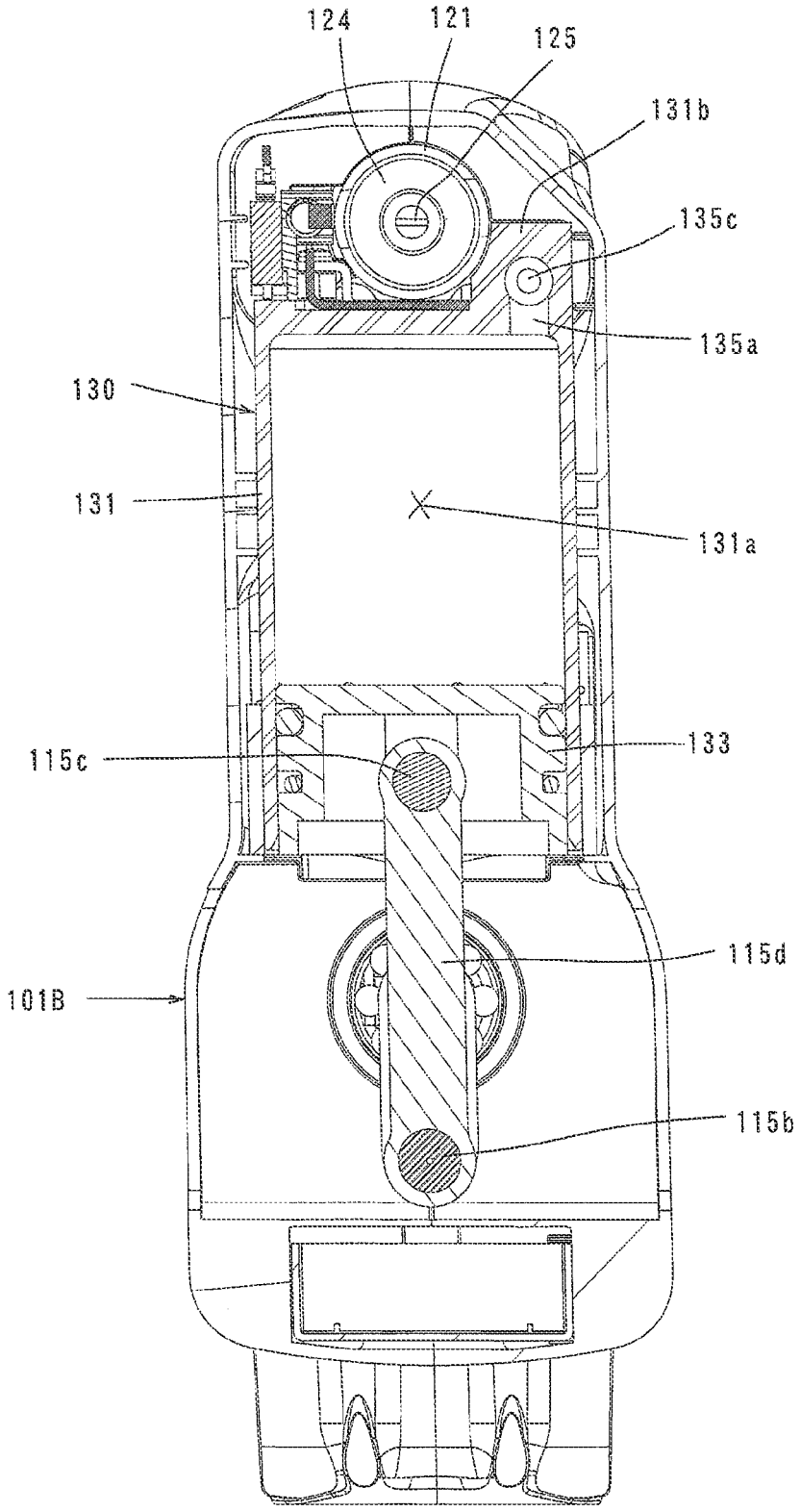
FIG. 26 is a sectional view taken along line Q-Q in FIG. 25.
Figure 27:
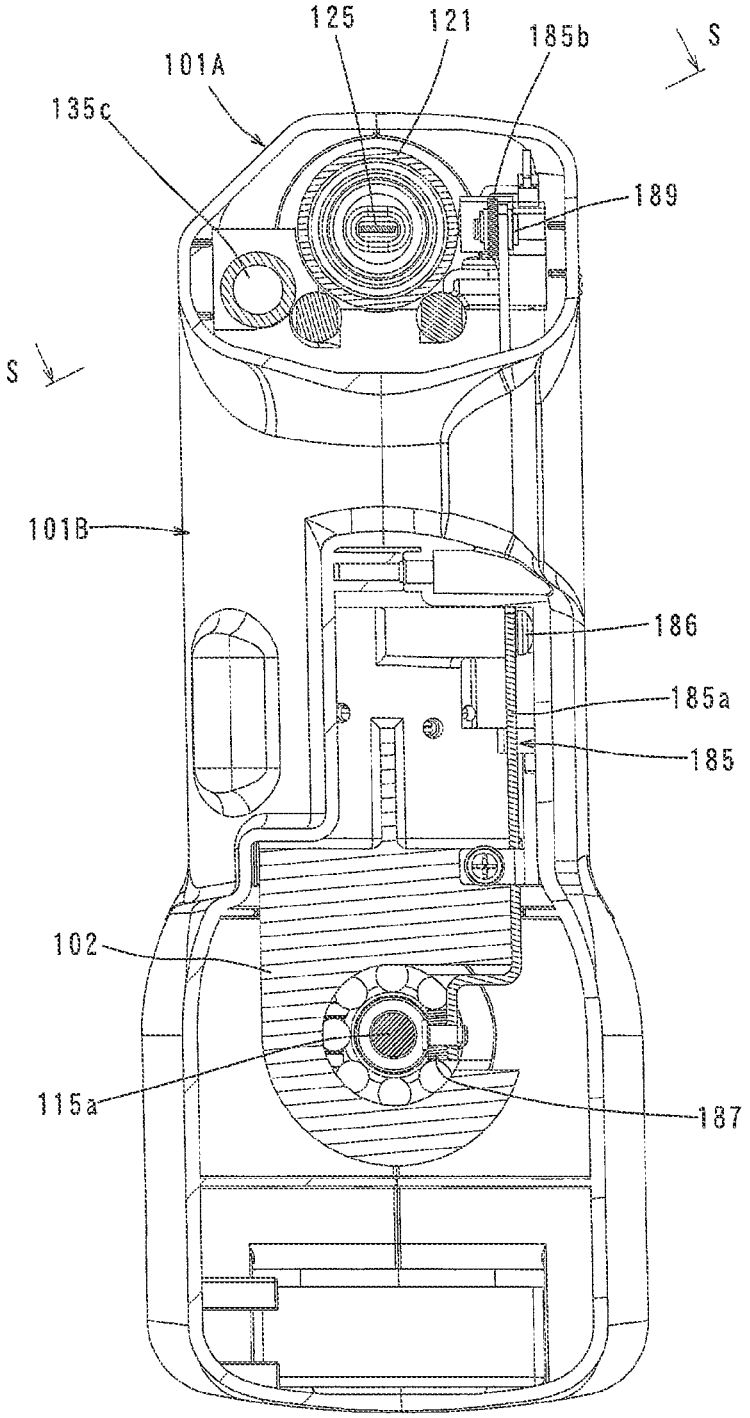
FIG. 27 is a sectional view taken along line R-R in FIG. 25.
Figure 28:
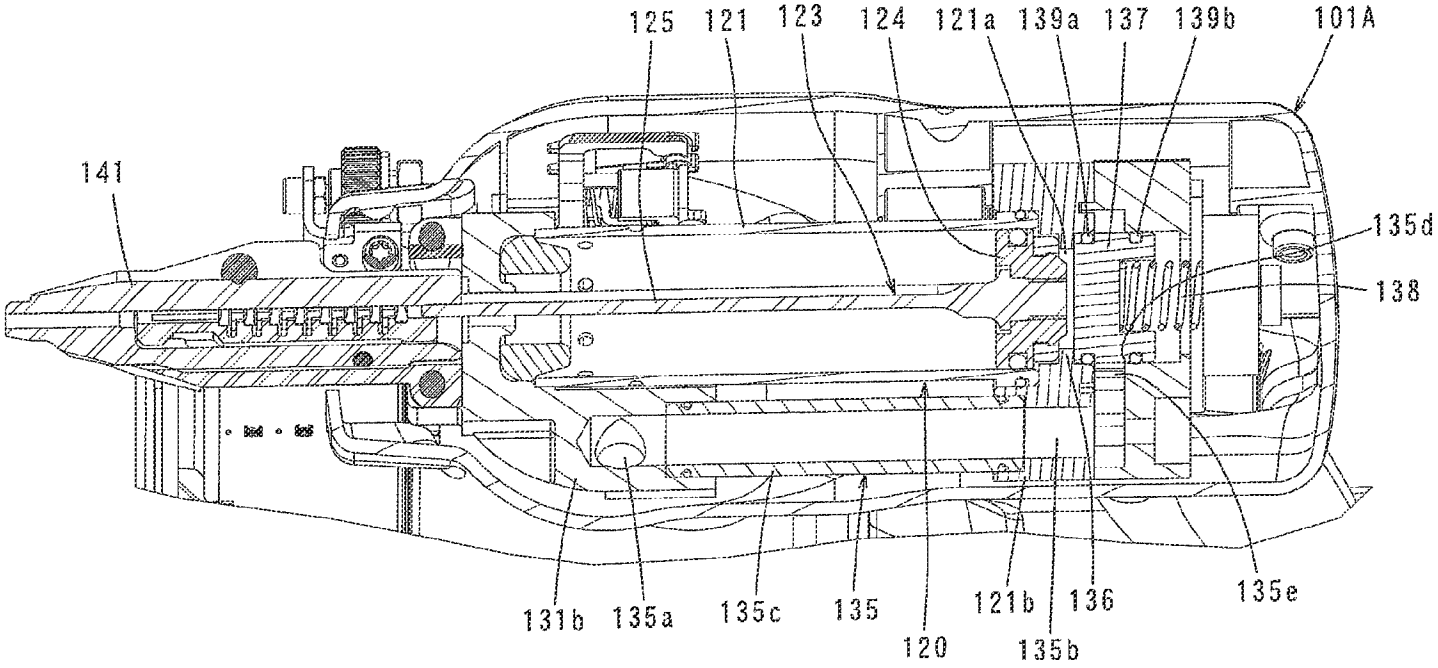
FIG. 28 is a sectional view taken along line S-S in FIG. 27.

As shown in FIG. 28, the nailer 100 has the air passage 135 that provides communication between the compression chamber 131*a* of the compression cylinder 131 and the cylinder chamber 121*a* of the driving cylinder 121, and the valve 137 that opens and closes the air passage 135. The air passage 135 and the valve 137 are example embodiments that correspond to the "compressed air supply passage" and the "valve member", respectively, according to the present invention. When the driving piston 123 is moved to a rear end position (to the left as viewed in FIG. 25) and the compression piston 133 is moved to a lower end position (bottom dead center) as shown in FIGS. 25 and 26, the nailer 100 is defined as being located in the initial position. Specifically, the position where the crank angle is zero degrees is the bottom dead center and is defined as the initial position.

As shown in FIG. 28, the air passage 135 mainly includes a communication port 135*a* open to the compression cylinder 131 side, a communication port 135*b* open to the driving cylinder 121 side, a communication path 135*c* that communicates between the communication ports 135*a*, 135*b*, a valve housing space 135*d* and an annular groove 135*e* formed in an inner circumferential surface of the valve housing space 135*d*. As shown in FIG. 26, the communication port 135*a* is formed in a cylinder head 131*b* of the compression cylinder 131 and communicates with the compression chamber 131*a*. As shown in FIG. 28, the communication port 135*b* is formed in a cylinder head 121*b* of the driving cylinder 121. One end of the communication port 135*b* communicates with the communication path 135*c*, and the other end communicates with the annular groove 135*e*. Specifically, the communication port 135*b* communicates with the valve housing space 135*d* via the annular groove 135*e*. As shown in FIG. 28, the communication path 135*c* is formed by a pipe-like member and extends in the front-rear direction along the driving cylinder 121. One end of the communication path 135*c* communicates with the communication port 135*a* and the other end communicates with the communication port 135*b*.

As shown in FIG. 28, the valve 137 is disposed in the valve housing space 135*d*. The valve housing space 135*d* has substantially the same inner diameter as the cylinder chamber 121*a* and is formed in the cylinder head 121*b* so as to communicate with the cylinder chamber 121*a*. Therefore, the valve 137 disposed in the valve housing space 135*d* is configured as a columnar member having substantially the same diameter as the piston body 124 of the driving piston 123 and arranged to be movable in the front-rear direction on the same axis as a driving line (axis of movement) of the driver 125 of the driving piston 123. By moving in the front-rear direction, the valve 137 provides communication between the compression chamber 131*a* and the cylinder chamber 121*a* or cuts off the communication. In other words, the valve 137 opens and closes the air passage 135.

Figure 30:
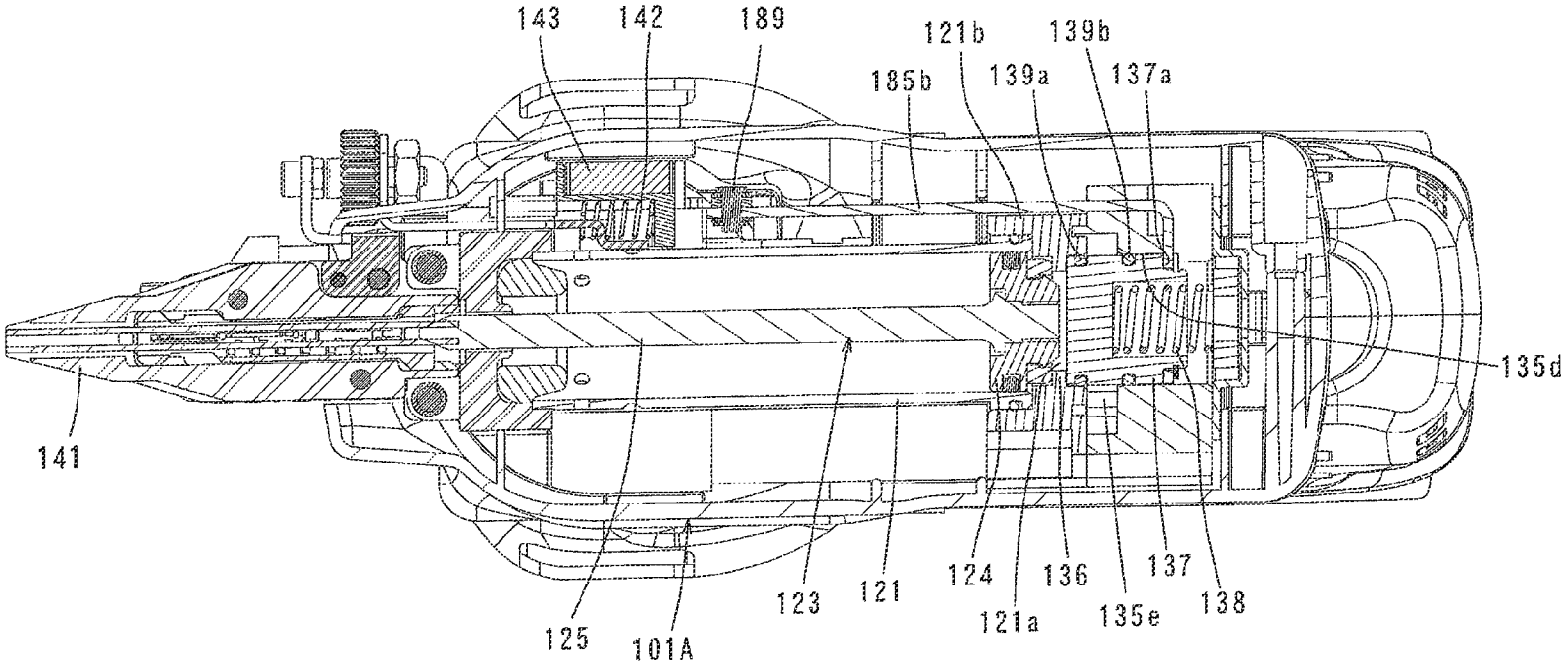
FIG. 30 is a sectional view taken along line T-T in FIG. 25 and showing a state in which the valve is located at a front position to cut off communication between a compression chamber and a cylinder chamber.
Figure 31:
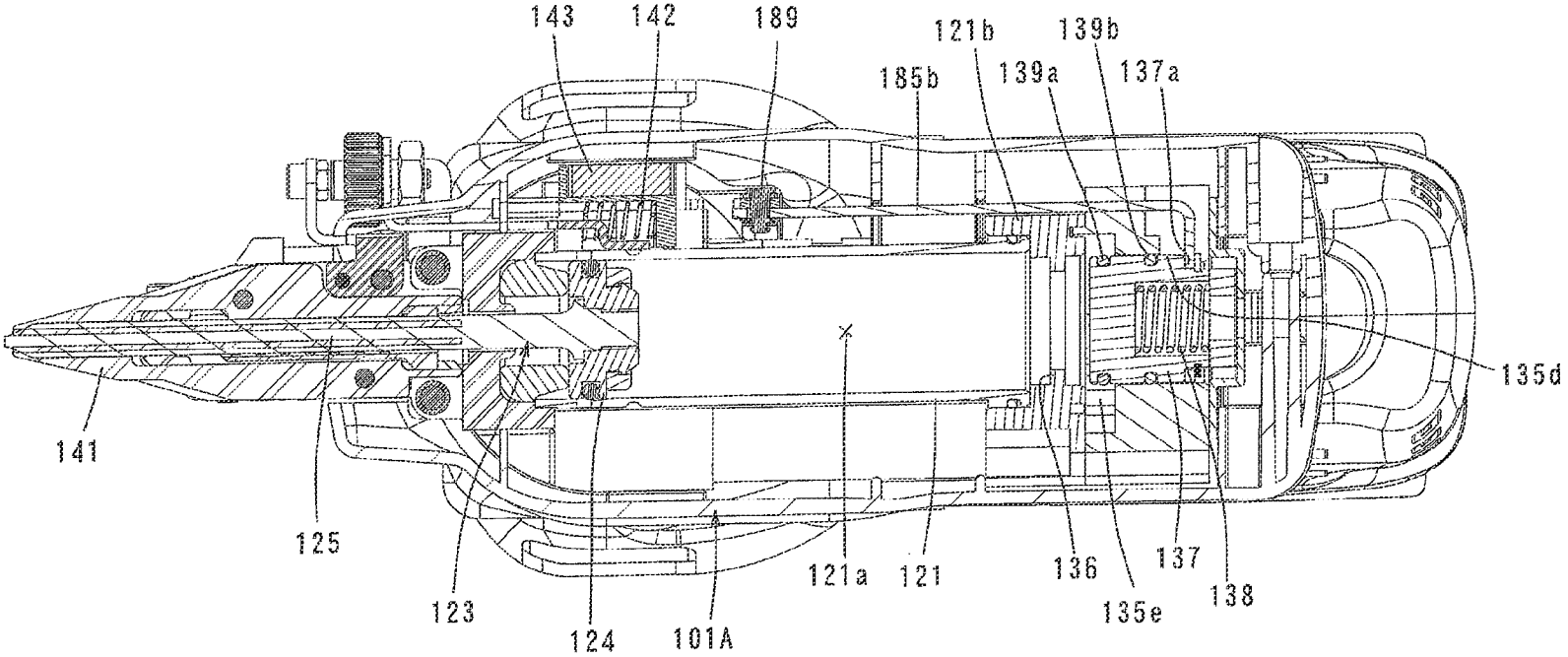
FIG. 31 is a sectional view showing a nail driving state in which the valve is located at a rear position to provide communication between the compression chamber and the cylinder chamber and a driving piston is moved forward.
Figure 32:
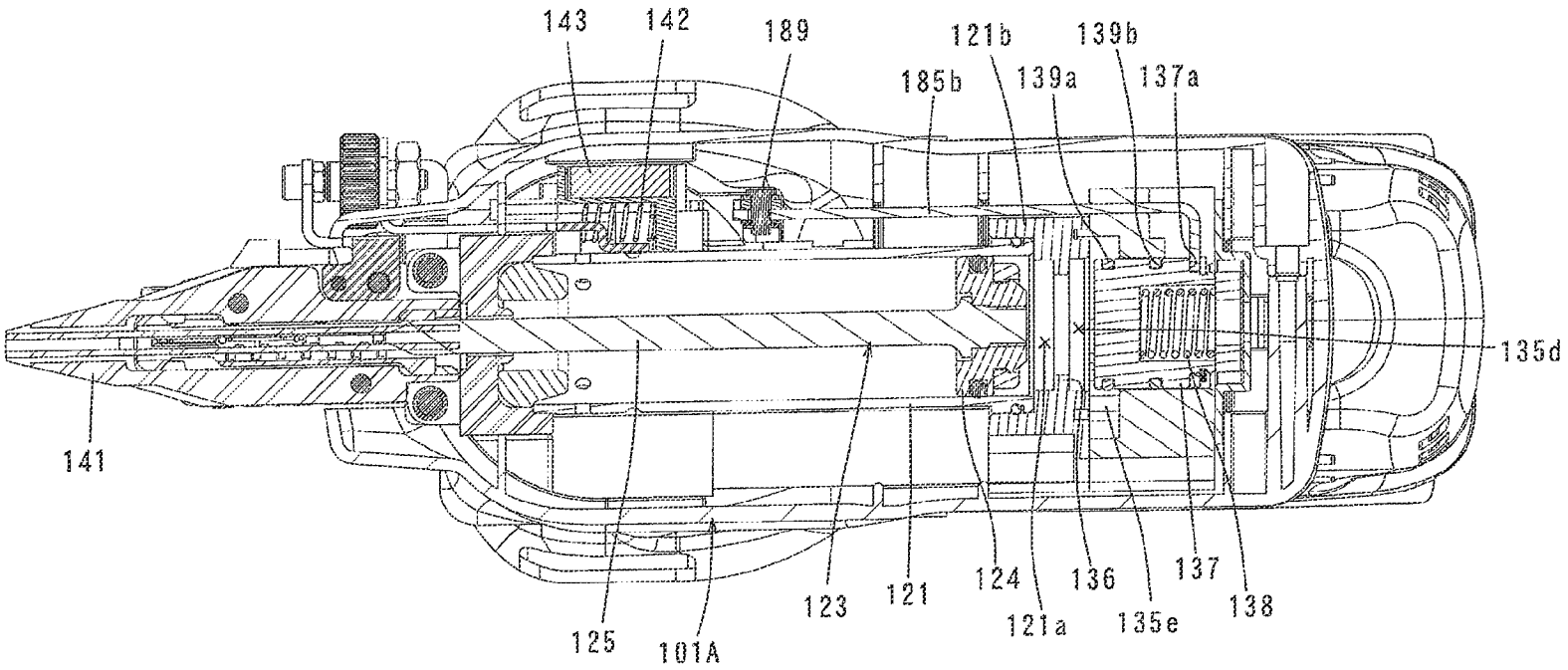
FIG. 32 is a sectional view showing a state in which the communication between the compression chamber and the cylinder chamber is maintained and the driving piston is returned near to a rear initial position.

Specifically, as shown in FIGS. 30 to 32, two O-rings 139*a*, 139*b* are provided on an outer periphery of the valve 137, spaced apart in the front-rear direction. When the front O-ring 139*a* is positioned in front of the annular groove 135*e* and in contact with an inner wall surface of the valve housing space 135*d*, communication between the compression chamber 131*a* and the cylinder chamber 121*a* is cut off. Further, when the O-ring 139*a* is moved into the region of the annular groove 135*e* that is spaced from the inner wall surface of the valve housing space 135*d*, the compression chamber 131*a* and the cylinder chamber 121*a* communicate with each other. FIG. 30 shows the closed state of the valve 137, and FIGS. 31 and 32 show the open state of the valve 137. Further, the rear O-ring 139*b* is provided to prevent the compressed air from leaking out through the communication port 135*b* and has no involvement in the communication between the compression chamber 131*a* and the cylinder chamber 121*a*. As described above, the valve 137 is provided in a connecting region of the air passage 135 which connects with the cylinder chamber 121*a* of the driving cylinder 121.

As shown in FIGS. 30 to 32, the valve 137 is normally biased forward by a compression coil spring 138 so as to cut off communication between the compression chamber 131*a* and the cylinder chamber 121*a*. Further, a stopper 136 is provided in front of the valve 137. The stopper 136 is formed by a flange-like member projecting radially inward into the cylinder chamber 121*a* and defines the rear end position of the driving piston 123 which moves rearward after a driving operation. Further, the stopper 136 defines the front end position of the valve 137 biased forward by the compression coil spring 138.

Figure 33:
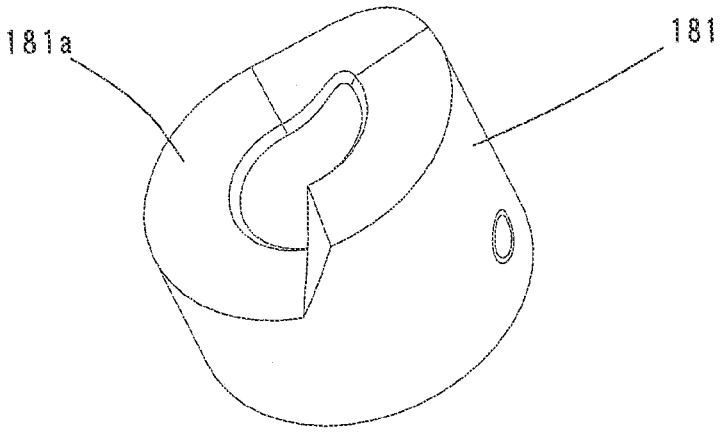
FIG. 33 is a perspective view showing a cylindrical cam.

The valve 137 is configured as a mechanical valve to be controlled by a cylindrical cam 181 (see FIGS. 25 and 33) which rotates in conjunction with the crank mechanism 115. Rotation of the cylindrical cam 181 is converted into linear motion in the front-rear direction by a link mechanism 185 (see FIG. 29) and is then transmitted to the valve 137. The link mechanism is an example embodiment that corresponds to the "relay member" according to the present invention. As shown in FIG. 33, the cylindrical cam 181 is an end face cam having a cam face 181*a* on one side in its axial direction. As shown in FIG. 25, the cylindrical cam 181 is fitted onto the crank shaft 115*a* and rotates together with the crank shaft 115*a*. The cam face 181*a* of the cylindrical cam 181 is shaped to have the same cam lift amount as the third cam plate 171 of the above-described modification. Thus, when the air in the compression chamber 131*a* is compressed to the maximum (the crank angle is 180 degrees), the valve 137 is moved rearward and provides communication between the compression chamber 131*a* and the cylinder chamber 121*a*. Further, the cam face 181*a* is shaped such that the valve 137 is held in the rear position until the crank angle (θ) reaches about 330 degrees. The cylindrical cam 181 is an example embodiment that corresponds to the "cam member" according to the present invention.

Figure 29:
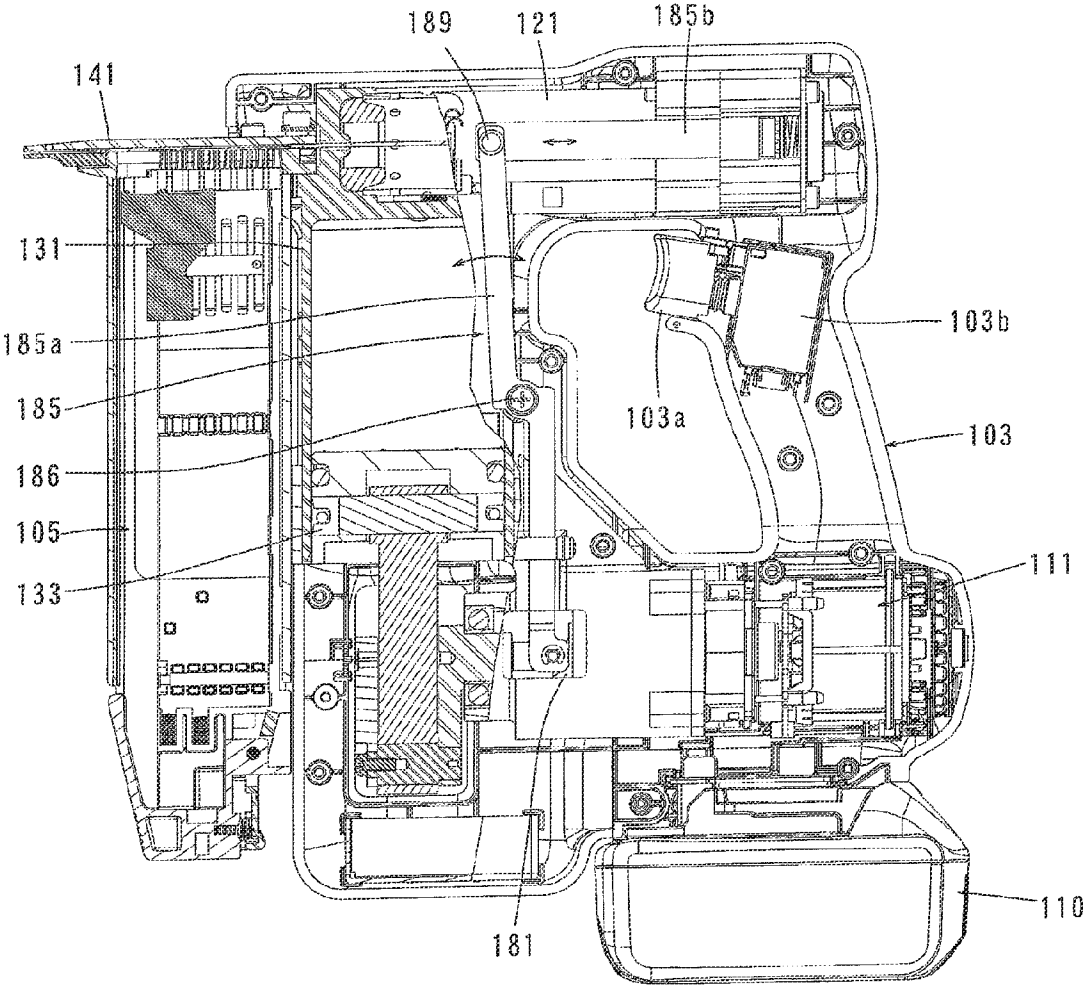
FIG. 29 shows a link mechanism for moving a valve.

As shown in FIG. 29, the link mechanism 185 includes a first link 185*a* and a second link 185*b*. The first link 185*a* is disposed to extend in the vertical direction along a lateral surface of the compression cylinder 131. The first link 185*a* is supported at its substantially central part in the vertical direction on the inner housing 102 by a support shaft 186 such that the first link 185*a* is pivotable in the front-rear direction. A lower end of the first link 185*a* is in contact with the cam face of the cylindrical cam 181 via a cam follower 187 (see FIG. 27). The second link 185*b* is disposed along a lateral surface of the driving cylinder 121 such that it is movable in the front-rear direction. As shown in FIGS. 30 to 32, one end (front end) of the second link 185*b* is connected to an upper end of the first link 185*a* by a pin 189 so as to be relatively rotatable. Further, the other end (rear end) of the second link 185*b* is engaged with an annular engagement recess 137*a* formed in the outer periphery of the valve 137.

Therefore, as shown in FIG. 29, when the upper end portion of the first link 185*a* is pivoted forward about the support shaft 186 and the second link 185*b* is moved forward, the valve 137 is moved forward and cuts off communication between the compression chamber 131*a* and the cylinder chamber 121*a* (see FIG. 30). On the other hand, when the upper end portion of the first link 185*a* is pivoted rearward and the second link 185*b* is moved rearward, the valve 137 is moved rearward and provides communication between the compression chamber 131*a* and the cylinder chamber 121*a* (see FIG. 31). Further, the biasing force of the compression coil spring 138, which biasing the valve 137 forward, acts in a direction to press the cam follower 187 against the cam face 181*a* of the cylindrical cam 181.

In the nailer 100 constructed as described above which is in the initial position as shown in FIGS. 25 and 26, when the contact arm switch 143 (see FIG. 30) is turned on by pressing the driver guide 141 against the workpiece and the trigger switch 103*b* (see FIG. 29) is turned on by depressing the trigger 103*a*, the electric motor 111 is energized. Thus, the crank mechanism 115 is driven via the speed reducing mechanism 113 and the compression piston 133 is moved upward. At this time, as shown in FIGS. 25 and 30, communication between the compression chamber 131*a* and the cylinder chamber 121*a* is kept cut off by the valve 137, so that the air in the compression chamber 131*a* is compressed.

When the compression piston 133 reaches near the top dead center or when the air in the compression chamber 131*a* is compressed to the maximum, the valve 137 is moved rearward via the cylindrical cam 181 and the link mechanism 185, so that the compression chamber 131*a* and the cylinder chamber 121*a* communicate with each other. When the compression chamber 131*a* and the cylinder chamber 121*a* communicate with each other, the compressed air in the compression chamber 131*a* is supplied into the cylinder chamber 121*a*, so that the valve 137 is moved to a fully open position as shown in FIG. 31. At the same time, the driving piston 123 is moved forward by the compressed air supplied into the cylinder chamber 121*a*. Then the driver 125 of the driving piston 123 strikes the nail in the driving passage 141*a* of the driver guide 141 and drives it into the workpiece.

When the driving piston 123 strikes the nail and drives it into the workpiece, impact vibrations are caused in the body 101 in the nail driving direction. At this time, however, the valve 137 disposed coaxially with the driving piston 123 moves rearward while compressing the compression coil spring 138 by the compressed air supplied into the cylinder chamber 121*a*. That is, the valve 137 acts as a counter weight. In this embodiment, the total mass of the valve 137 and the link mechanism 185 connected to the valve 137 is set to be substantially equal to the mass of the driving piston 123. Therefore, vibrations generated during the nail driving operation of the driving piston 123 are efficiently reduced by the counter weight constituted by the valve 137 and the link mechanism 185.

The compression piston 133 moves downward after the compressing operation. At this time, the volume of the compression chamber 131*a* is increased so that the pressure in the compression chamber 131*a* is reduced. The pressure in the compression chamber 131*a* acts on the driving piston 123 via the air passage 135 and the cylinder chamber 121*a*. By this pressure reduction, as shown in FIG. 32, air in the cylinder chamber 121*a* is sucked into the compression chamber 131*a*, and the driving piston 123 is moved rearward and comes into contact with the stopper 136. Thus, the driving piston 123 is returned to the initial position. The valve 137 maintains the communication between the compression chamber 131*a* and the cylinder chamber 121*a* until the driving piston 123 has returned to the initial position. However, when the compression piston 133 comes close to the initial position or the bottom dead center, the valve 137 is moved forward by the biasing force of the compression coil spring 138 and cuts off the communication between the compression chamber 131*a* and the cylinder chamber 121*a*. Further, when the compression piston 133 is returned to the initial position, the supply of current to the electric motor 111 is interrupted and the electric motor 111 is stopped even if the trigger switch 103*b* and the contact arm switch 143 are held in the on state. In this manner, one cycle of the nail driving operation is completed According to the above-described embodiment, the link mechanism 185 is pivoted on the support shaft 186 in the front-rear directions according to the rotation of the cylindrical cam 181, which causes the valve 137 to move so as to open and close the air passage 135. Therefore, power is rationally transmitted from the cylindrical cam 181 to the valve 137 via the link mechanism 185. Particularly, by arranging the link mechanism 185 outside and alongside the compression cylinder 131, space for disposing the component parts can be efficiently utilized.

In addition, according to this embodiment, the valve 137 is disposed coaxially with the driving piston 123 and is moved in an opposite direction from the nail driving direction of the driving piston 123 by the compressed air supplied into the cylinder chamber 121*a*. Thereby, the valve 137 acts as a counter weight. As a result, vibrations generated during the nail driving operation of the driving piston 123 are reduced.

In addition, according to this embodiment, the valve 137 has substantially the same diameter as the piston body 124 of the driving piston 123. In other words, the pressure receiving area of the valve 137 that receives the pressure of the compressed air supplied into the compression chamber 131*a* is set to be substantially equal to the pressure receiving area of the driving piston 123 that receives the pressure of the compressed air. Therefore, the valve 137 efficiently acts as the counter weight.

In addition, according to this embodiment, because the communication path 135*c* connects the compression chamber 131*a* of the compression cylinder 131 and the cylinder chamber 121*a* of the driving cylinder 121, the degree of freedom increases in the relative arrangement of the compression cylinder 131 and the driving cylinder 121. In this case, the cylindrical member forming the communication path 135*c* is disposed alongside the driving cylinder 121, so that the cylindrical member avoids interference with other components. Further, the cylindrical member may be formed of a hard material or formed of a flexible material, which can be freely bent during assembly.

In addition, according to this embodiment, in the air passage 135 which connects the compression chamber 131*a* of the compression cylinder 131 and the cylinder chamber 121*a* of the driving cylinder 121, the valve 137 is disposed in a connecting region that connects with the cylinder chamber 121*a*. Thus, the air passage 135 forms a portion of the compression chamber 131*a*. Therefore, when the compressed air is supplied into the cylinder chamber 121*a* of the driving cylinder 121, the compressed air is prevented from expanding. Specifically, energy losses of the compressed air are reduced. As a result, the nail driving operation is performed with excellent energy efficiency.

Furthermore, in the above-described embodiments, the cylindrical cam 181 is configured as an end face cam, but a cylindrical grooved cam having a groove on its outer circumferential surface may be used in place of the end face cam. Further, although the above-described embodiment described the nailer 100 as an example of the driving tool, it may also be applied to driving tools, other than nailers, known as tackers and staplers.

(Correspondences Between the Features of the Embodiments and the Features of the Invention)

The above-described embodiments are examples for embodying the present invention. However, it is not limited to the structures of the representative embodiments. Furthermore, correspondences between the features of the embodiments and the features of the invention are as follows.

The nailer 100 is an example embodiment that corresponds to the "driving tool" according to the present invention.

The electric motor 111 is an example embodiment that corresponds to the "motor" according to the present invention.

The crank mechanism 115 is an example embodiment that corresponds to the "crank mechanism" according to the present invention.

The crank shaft 115*a* is an example embodiment that corresponds to the "crank shaft" according to the present invention.

The driving cylinder 121 is an example embodiment that corresponds to the "cylinder" according to the present invention.

The cylinder chamber 121*a* is an example embodiment that corresponds to the "cylinder chamber" according to the present invention.

The driving piston 123 is an example embodiment that corresponds to the "first piston" according to the present invention.

The piston body 124 is an example embodiment that corresponds to the "sliding part" according to the present invention.

The driver 125 is an example embodiment that corresponds to the "driving part" according to the present invention.

The compression device 130 is an example embodiment that corresponds to the "compression device" according to the present invention.

The compression chamber 131*a* is an example embodiment that corresponds to the "compression chamber" according to the present invention.

The compression piston 133 is an example embodiment that corresponds to the "second piston" according to the present invention.

The air passage 135 is an example embodiment that corresponds to the "compressed air supply passage" according to the present invention.

The valve 137 is an example embodiment that corresponds to the "valve member" according to the present invention.

The first cam plate 153 is an example embodiment that corresponds to the "cam member" according to the present invention.

The second cam plate 155 is an example embodiment that corresponds to the "cam member" according to the present invention.

The third cam plate 171 is an example embodiment that corresponds to the "cam member" according to the present invention.

The first cam follower 157 is an example embodiment that corresponds to the "cam follower" according to the present invention.

The second cam follower 159 is an example embodiment that corresponds to the "cam follower" according to the present invention.

The motion transmitting member 161 is an example embodiment that corresponds to the "relay member" according to the present invention.

The cylindrical cam 181 is an example embodiment that corresponds to the "cam member" according to the present invention.

The link mechanism 185 is an example embodiment that corresponds to the "relay member" according to the present invention.

The support shaft 186 is an example embodiment that corresponds to the "rotating shaft" according to the present invention.

EXPLANATION OF THE NUMERALS

100 nailer
101 body housing
101A driving mechanism housing part
101B compression device housing part
101C motor housing part
102 inner housing
103 handle
103*a* trigger
103*b* trigger switch
105 magazine
107 body housing
107*a* rear connecting plate
107*b* front connecting plate
109 driving part housing
110 battery pack
111 electric motor
113 speed reducing mechanism
115 crank mechanism
115*a* crank shaft
115*b* crank pin
115*c* crank plate
115*d* connecting rod
115*e* connecting pin
120 nail driving mechanism
121 driving cylinder
121*a* cylinder chamber
121*b* cylinder head
135*e* annular groove

123 driving piston
124 piston body
125 driver
127 through hole
130 compression device
131 compression cylinder
131*a* compression chamber
131*b* cylinder head
133 compression piston
133*a* piston body
135 air passage
135*a* communication port
135*b* communication port
135*c* communication path
136 stopper
137 valve
137*a* engagement recess
138 compression coil spring
139*a*, 139*b* O-ring
139 atmosphere communication port
141 driver guide
141*a* driving passage
143 contact arm switch
151 cam mechanism
153 first cam plate
155 second cam plate
157 first cam follower
157*a* flat surface
159 second cam follower
159*a* protruding part
159*b* contact part
161 motion transmitting member
161*a* side part
161*b* rear part
161*c* front part
162 first guide rod
163 first coil spring
164 screw
165 second guide rod
167 second coil spring
171 third cam plate
173 third cam follower
181 cylindrical cam
181*a* cam surface
185 link mechanism
185*a* first link
185*b* second link
186 support shaft
187 cam follower
189 pin

The invention claimed is:

1. A driving tool configured to drive an object by striking it, comprising:

a motor, a cylinder having a cylinder chamber, a first piston slidably disposed within the cylinder chamber, the first piston having an elongated driving part connected to a sliding part and configured to strike the object, a compression device having a compression chamber, a second piston slidably disposed within the compression chamber, the second piston being configured to be driven by the motor and to generate compressed air by changing an internal volume of the compression chamber, a compressed air supply passage defining a compressed air communication path between the compression chamber and the cylinder chamber, a valve member, a crank mechanism configured to be driven by the motor to reciprocate the second piston within the compression chamber, and a rotatably-driven cam member connected to the crank mechanism, a relay member that mechanically connects the cam member with the valve member, and is configured to convert rotation of the cam member into linear motion and to transmit the linear motion to the valve member, wherein:

the first piston is configured to be moved by the compressed air supplied from the compression chamber into the cylinder chamber from an initial position to strike the object, the valve member is configured to open and close the compressed air supply passage according to an amount of cam lift of the cam member, and the amount of cam lift of the cam member is set such that the compressed air supply passage is held open by the valve member until the first piston has struck the object and has returned to the initial position.

2. The driving tool as defined in claim 1, wherein the amount of cam lift of the cam member is set such that the valve member opens the compressed air supply passage when the air in the compression chamber is maximally or substantially maximally compressed.

3. The driving tool as defined in claim 1, wherein the cam member is constituted by a combination of a plurality of cam plates, and the amount of cam lift relative to the relay member is determined by the combination of the cam plates.

4. The driving tool as defined in claim 3, wherein a position of at least one of the cam plates is adjustable, and an opening timing of the compressed air supply passage by the valve member is configured to be adjustable by adjusting the position of the at least one of the cam plates.

5. The driving tool as defined in claim 3, further comprising:

a plurality of cam followers respectively contacting the plurality of cam plates, wherein rotation of the cam plates is individually transmitted to the relay member via the respective cam followers.

6. The driving tool as defined in claim 1, wherein:

the cylinder and the compression device are each formed as a cylindrical cylinder having a longitudinal axis and an outer wall, the cylindrical cylinders are disposed in parallel to each other such that the longitudinal axes of the cylindrical cylinders extend in a first direction, and the relay member is arranged to extend in the first direction between the outer wall of the cylinder and the outer wall of the compression device.

7. A driving tool configured to drive an object by striking it, comprising:

a motor, a cylinder having a cylinder chamber, a first piston slidably disposed within the cylinder chamber, the first piston having an elongated driving part connected to a sliding part and configured to strike the object, a compression device having a compression chamber, a second piston slidably disposed within the compression chamber, the second piston being configured to be driven by the motor and to generate compressed air by changing an internal volume of the compression chamber, a compressed air supply passage defining a compressed air communication path between the compression chamber and the cylinder chamber, a valve member, a relay member that mechanically connects the motor with the valve member and is configured to move the valve member when the motor is driven, a crank mechanism configured to be driven by the motor to reciprocate the second piston within the compression chamber, and a rotatably-driven cam member connected to the crank mechanism, wherein:

the first piston is configured to be moved by the compressed air supplied from the compression chamber into the cylinder chamber from an initial position to strike the object, the crank mechanism has a crank shaft, the cam member is configured to be rotatably driven around the crank shaft, the relay member is configured to move in a direction crossing an axial direction of the crank shaft so as to convert the rotation of the cam member into linear motion and to transmit the linear motion to the valve member, and the valve member is configured to open and close the compressed air supply passage according to an amount of cam lift of the cam member by moving in the crossing direction.

8. The driving tool as defined in claim 7, wherein the amount of cam lift of the cam member is set such that the valve member opens the compressed air supply passage when the air in the compression chamber is maximally or substantially maximally compressed.

9. The driving tool as defined in claim 7, wherein the cam member is constituted by a combination of a plurality of cam plates, and the amount of cam lift relative to the relay member is determined by the combination of the cam plates.

10. The driving tool as defined in claim 9, wherein a position of at least one of the cam plates is adjustable, and an opening timing of the compressed air supply passage by the valve member is configured to be adjustable by adjusting the position of the at least one of the cam plates.

11. The driving tool as defined in claim 9, further comprising:

a plurality of cam followers respectively contacting the plurality of cam plates, wherein rotation of the cam plates is individually transmitted to the relay member via the respective cam followers.

12. The driving tool as defined in claim 7, wherein:

the cylinder and the compression device are each formed as a cylindrical cylinder having a longitudinal axis and an outer wall, the cylindrical cylinders are disposed in parallel to each other such that the longitudinal axes of the cylindrical cylinders extend in a first direction, and the relay member is arranged to extend in the first direction between the outer wall of the cylinder and the outer wall of the compression device.

13. A driving tool configured to drive an object by striking it, comprising:

a motor, a cylinder having a cylinder chamber, a first piston slidably disposed within the cylinder chamber, the first piston having an elongated driving part connected to a sliding part and configured to strike the object, a compression device having a compression chamber, a second piston slidably disposed within the compression chamber, the second piston being configured to be driven by the motor and to generate compressed air by changing an internal volume of the compression chamber, a compressed air supply passage defining a compressed air communication path between the compression chamber and the cylinder chamber, a valve member, a crank mechanism configured to be driven by the motor to reciprocate the second piston within the compression chamber, a rotatably-driven cam member connected to the crank mechanism, and a relay member that mechanically connects the cam member with the valve member, wherein:

the first piston is configured to be moved by the compressed air supplied from the compression chamber into the cylinder chamber from an initial position to strike the object, the crank mechanism has a crank shaft, the cam member is configured to be rotatably driven around the crank shaft, the relay member is configured to be reciprocally pivoted, with a rotating shaft serving as its fulcrum, in a direction containing a component in a direction of a rotation axis of the cam member, and to convert rotation of the cam member into linear motion and to transmit the linear motion to the valve member, and the valve member is configured to open and close the compressed air supply passage according to an amount of cam lift of the cam member by moving in an axial direction of the first piston.

14. The driving tool as defined in claim 13, wherein the relay member is arranged to extend alongside an axial direction of the second piston outside the compression device, and the fulcrum of the relay member is provided in a middle region of the relay member in the axial direction of the second piston.

15. The driving tool as defined in claim 13, wherein the valve member is disposed coaxially with the first piston, and when the compressed air supplied into the cylinder chamber causes the first piston to strike the object, the valve member is configured to move in an opposite direction from a direction in which the first piston is moved by the compressed air.

16. The driving tool as defined in claim 15, wherein:

the valve member has a first pressure receiving area configured to receive pressure of the compressed air supplied from the compression chamber into the cylinder chamber, the sliding part has a second pressure receiving area configured to receive the pressure of the compressed air supplied from the compression chamber into the cylinder chamber, and the first pressure receiving area equals the second pressure receiving area.

* * * * *